US008132883B2

(12) United States Patent
Niihara et al.

(10) Patent No.: US 8,132,883 B2
(45) Date of Patent: Mar. 13, 2012

(54) IMAGE FORMING APPARATUS AND SHEET TRANSPORTING APPARATUS

(75) Inventors: Takayuki Niihara, Kanagawa (JP); Mamoru Yorimoto, Tokyo (JP); Yuichiro Maeyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 400 days.

(21) Appl. No.: 12/535,817

(22) Filed: Aug. 5, 2009

(65) Prior Publication Data

US 2010/0066781 A1 Mar. 18, 2010

(30) Foreign Application Priority Data

Sep. 12, 2008 (JP) ..... 2008-235686

(51) Int. Cl.
*B41J 29/38* (2006.01)
*B41J 2/01* (2006.01)
*B65H 29/24* (2006.01)

(52) U.S. Cl. ..... 347/16; 347/104; 271/276; 271/194

(58) Field of Classification Search ..... 347/16, 347/104

See application file for complete search history.

(56) References Cited

U.S. PATENT DOCUMENTS

| | | | | |
|---|---|---|---|---|
| 2008/0122890 | A1 | 5/2008 | Yorimoto | |
| 2008/0225066 | A1 | 9/2008 | Yorimoto et al. | |
| 2008/0225067 | A1 | 9/2008 | Morino et al. | |
| 2008/0225068 | A1 | 9/2008 | Morino et al. | |
| 2008/0225098 | A1 | 9/2008 | Hagiwara et al. | |
| 2008/0231649 | A1 | 9/2008 | Kawabata et al. | |
| 2009/0015621 | A1 | 1/2009 | Hirota et al. | |
| 2009/0136258 | A1 | 5/2009 | Naruse et al. | |
| 2009/0148181 | A1 | 6/2009 | Niihara et al. | |
| 2009/0184993 | A1 | 7/2009 | Yorimoto et al. | |
| 2009/0185813 | A1 | 7/2009 | Hagiwara et al. | |
| 2009/0189937 | A1 | 7/2009 | Naruse et al. | |
| 2009/0244246 | A1* | 10/2009 | Nakamaki et al. | 347/104 |

FOREIGN PATENT DOCUMENTS

| | | |
|---|---|---|
| JP | 2005-231126 | 9/2005 |
| JP | 2006-168948 | 6/2006 |
| JP | 2007-45596 | 2/2007 |

* cited by examiner

*Primary Examiner* — Julian Huffman
(74) *Attorney, Agent, or Firm* — Cooper & Dunham LLP

(57) ABSTRACT

An inkjet-type image forming apparatus includes a recording head configured to eject ink to form an image; a carriage where the recording head is provided, the carriage being configured to reciprocate in a direction orthogonal to a sheet transport direction; a transport unit disposed upstream of a print area in the sheet transport direction, the transport unit being configured to intermittently transport a sheet to the print area; a transport control unit configured to control the transport unit; a platen guide plate; a suction unit configured to suction the sheet onto the platen guide plate; and a control unit.

11 Claims, 26 Drawing Sheets

IMAGE FORMING APPARATUS AND SHEET TRANSPORTING APPARATUS

CROSS-REFERENCE TO RELATED APPLICATIONS

This patent application is based upon and claims the benefit of priority of Japanese Patent Application No. 2008-235686 filed on Sep. 12, 2008, the entire contents of which are incorporated herein by reference.

BACKGROUND OF THE INVENTION

1. Field of the Invention

The present invention generally relates to image forming apparatuses and sheet transporting apparatuses. More specifically, the present invention relates to an image forming apparatus where a sheet transported to a platen guide plate is suctioned (forced) onto the platen guide plate by a suction unit and an ink droplet ejected from a recording head is attached to the surface of the sheet to form an image, and a sheet transporting apparatus.

2. Description of the Related Art

As an image forming apparatus such as a printer, a facsimile apparatus, a copying apparatus or a printer/fax/copier multi-function peripheral, for example, there is known an inkjet recording apparatus in which a recording head (image forming unit) including a liquid ejection head is used to eject droplets of recording liquid. While a sheet (the material is not limited to paper, and a recorded medium, a recording medium, a transfer member, or a recording paper may also be used having the same meaning) is transported, the droplets of the recording liquid (hereinafter the "ink droplet") are attached to the sheet and image formation (recording, imaging or printing may also be used having the same meaning) is performed.

When an image is formed by an inkjet recording system, at the time of printing when ink is jetted onto a sheet and an image is formed, the planar precision of the surface of the sheet is important. In the sheet, for example, when humidity is high or the sheet is thin, a state where a sheet edge is curved (hereinafter, this state is called "curl" or "loop") is likely to occur. When the sheet in which such a curl occurs is directly transported to a platen guide plate and printing is performed, the distance between a nozzle of a recording head and the surface of the sheet varies. Thus, the sheet may come in contact with the nozzle surface of the recording head, so that the nozzle surface of the head is soiled or the sheet itself is soiled. Besides, the landing position of the jetted ink droplet is shifted so as to influence the image quality regarding coloring, white streaks, black streaks or the like, and there is a risk that the image quality will be degraded.

As an image forming apparatus to prevent the influence due to the deformation of a sheet as stated above, for example, as disclosed in patent document 1, there is an apparatus where a paper feed motor is stopped just before a sheet reaches a print area; sheet transport is temporarily stopped; the driving of the paper feed motor is resumed after a specified standby time required to change a reverse curl state of the sheet to a forward curl state elapses; and a sub-scanning motor is driven to transport the sheet adsorbed on a transport belt to the print area.

[Patent document 1] Japanese Patent Application Publication No. 2007-45596

However, in the image forming apparatus disclosed in the patent document 1, the standby time in which the reverse curl state of the sheet is changed to the forward curl state must be changed according to conditions such as humidity and paper quality. When the standby time becomes long, a time (print time) in which the sheet passes through the print area becomes long. Thus, there is a problem that printing efficiency may be reduced.

SUMMARY OF THE INVENTION

Accordingly, embodiments of the present invention may provide a novel and useful image forming apparatus and sheet transporting apparatus solving one or more of the problems discussed above.

More specifically, the embodiments of the present invention may provide an image forming apparatus in which the influence of a curl of a sheet is eliminated and image quality precision in printing is improved, and a sheet transporting apparatus.

One aspect of the present invention may be to provide an inkjet-type image forming apparatus, including a recording head configured to eject ink to form an image; a carriage where the recording head is provided, the carriage being configured to reciprocate in a direction orthogonal to a sheet transport direction; a transport unit disposed upstream of a print area in the sheet transport direction, the transport unit being configured to intermittently transport a sheet to the print area; a transport control unit configured to control the transport unit; a platen guide plate to support the sheet in the print area; a suction unit configured to suction the sheet onto the platen guide plate; and a control unit configured to stop the suction unit before the sheet is transported to the print area, forward transport the sheet by the transport unit by a specified distance obtained by adding an extended distance to a target intermittent transport distance, actuate the suction unit to cause the sheet to be forced onto the platen guide plate, and reverse transport the sheet by the transport unit to cause a leading edge of the sheet to be located at the downstream end of the intermittent transport distance.

Other aspect of the present invention may be to provide an inkjet-type image forming apparatus, including a recording head configured to eject ink to form an image; a carriage where the recording head is provided, the carriage being configure to reciprocate in a direction orthogonal to a sheet transport direction; a first transport unit disposed upstream of a print area in the sheet transport direction, the first transport unit being configured to intermittently transport a sheet to the print area; a second transport unit disposed downstream of the print area, the second transport unit configured to exert a transporting force on the sheet when printed; a transport control unit configured to control the first and the second transport units; a platen guide plate to support the sheet in the print area; a suction unit configured to suction the sheet onto the platen guide plate; and a control unit configured to stop the suction unit before the sheet is transported to the print area until the sheet is transported to the second transport unit and the transporting force is obtained, forward transport the sheet by the first transport unit by a specified distance obtained by adding an extended distance to a target intermittent transport distance, actuate the suction unit to cause the sheet to be forced onto the platen guide plate, and reverse transport the sheet by the first transport unit to cause a leading edge of the sheet to be located at the downstream end of the intermittent transport distance.

Other aspect of the present invention may be to provide a sheet transporting apparatus, including a platen guide plate configured to support a sheet in a print area; a transport unit configured to intermittently transport the sheet to the platen guide plate; a transport control unit configured to control the transport unit; a suction unit configured to suction the sheet onto the platen guide plate; and a control unit configured to stop the suction unit before the sheet is transported to the print area, forward transport the sheet by the transport unit by a specified distance obtained by adding an extended distance to a target intermittent transport distance, actuate the suction unit to cause the sheet to be forced onto the platen guide plate, and reverse transport the sheet by the transport unit to cause a leading edge of the sheet to be located at the downstream end of the intermittent transport distance.

According to embodiments of the present invention, the sheet transported along the platen guide plate is forced onto the platen guide plate at the time of printing and the sheet can be held in the plane state where the curl (loop) does not occur in the sheet. It is not necessary to provide a standby time for removing the curl (loop) of the sheet. Accordingly, the time required for printing is shortened and the printing efficiency can be raised. Further, the sheet is prevented from contacting the nozzle surface of the recording head. As a result of this, the nozzle surface of the head and the sheet are not soiled. Besides, the image quality is improved and the printing precision is raised, so that the reliability of precise printing can be raised.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims.

It is to be understood that both the foregoing general description and the following detailed description are exemplary and explanatory only and are not restrictive of the invention as claimed.

DETAILED DESCRIPTION OF THE PREFERRED EMBODIMENTS

A description is given below, with reference to the FIG. 1 through FIG. 14B of embodiments of the present invention.

Figure 1:
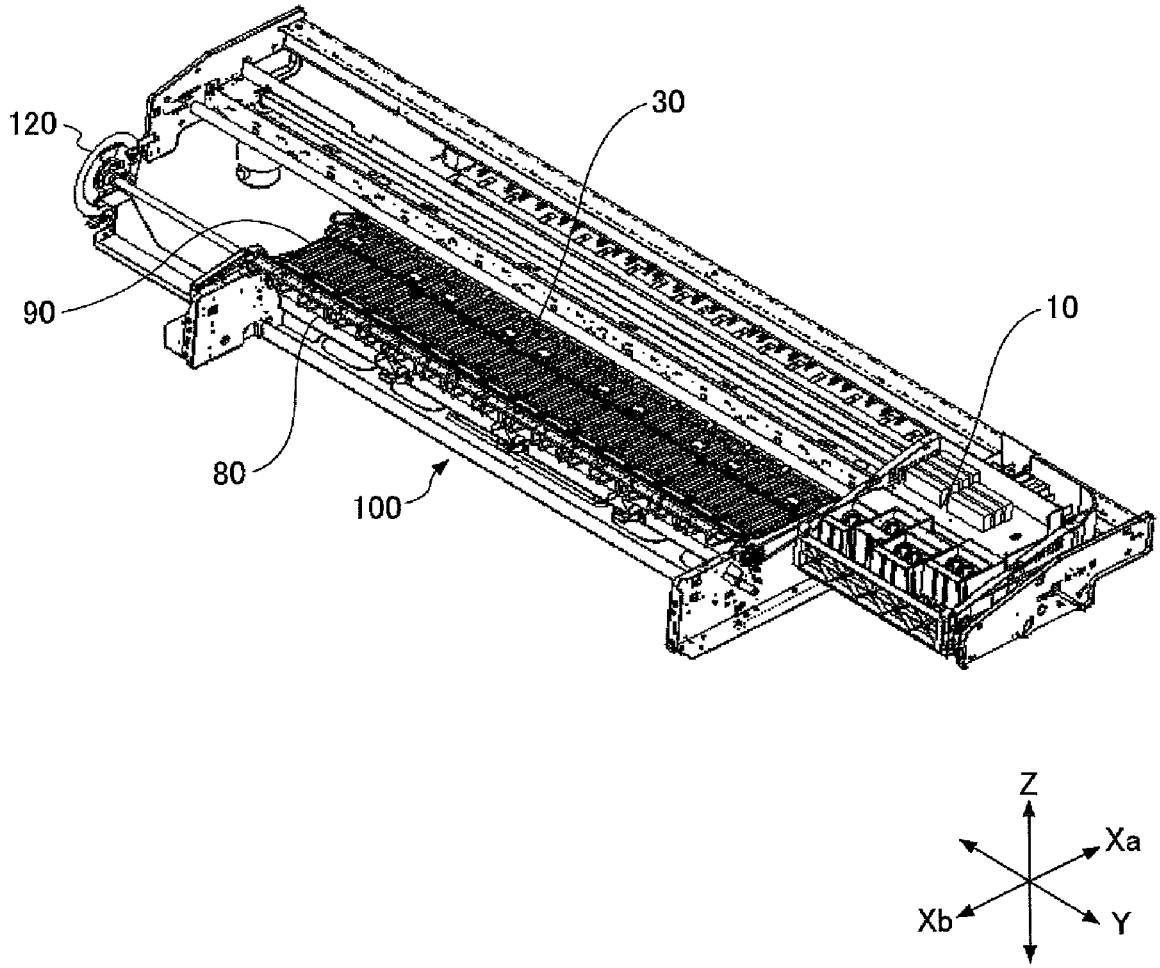
FIG. 1 is a perspective view showing an embodiment of an image forming apparatus and a sheet transporting apparatus according to the present invention.
Figure 2:
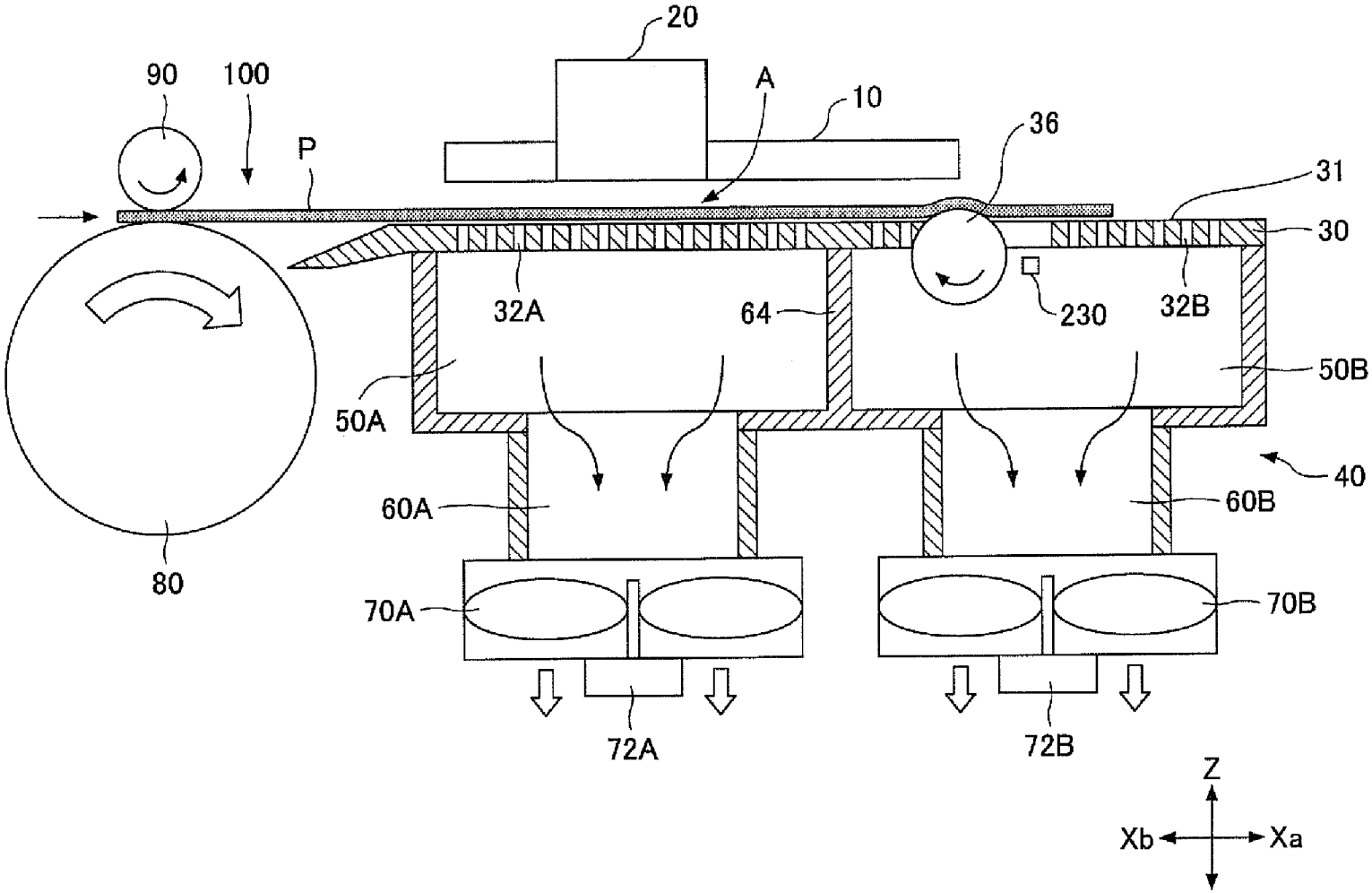
FIG. 2 is a side longitudinal cross-sectional view schematically showing a positional relationship among a recording head, a platen guide plate and a suction unit.

FIG. 1 is a perspective view showing an embodiment of an image forming apparatus and a sheet transporting apparatus according to the present invention. FIG. 2 is a side longitudinal cross-sectional view schematically showing a positional relationship among a recording head, a platen guide plate and a suction unit. As shown in FIG. 1 and FIG. 2, an inkjet-type image forming apparatus is mounted in, for example, a printer. A recording head 20 (shown in FIG. 2) is disposed on a carriage 10 capable of performing reciprocating linear movement in a Y-direction orthogonal to a paper transport direction (X-direction). The inkjet-type recording head 20 includes plural ink nozzles for ejecting respective color inks of black, magenta, cyan, yellow and the like.

Besides, a horizontal sheet guide surface 31 configured to guide a sheet being transported is formed on the upper surface of a platen guide plate 30. The sheet guide surface 31 includes plural suction holes 32A for sheet suction in positions facing a print area A and plural suction holes 32B disposed downstream of the print area A. The platen guide plate 30 is disposed on a sheet transport path. A transport roller (first transport unit) 80 and a pressure roller 90 are provided at the upstream side of the platen guide plate 30. A suction transport roller (second transport unit) 36 is provided in the vicinity of the suction holes 32B at the downstream side.

Further, a suction unit 40 configured to evacuate air is formed below the plural suction holes 32A and 32B. The suction unit 40 includes air chambers 50A and 50B in which the air-tightness is kept, ducts 60A and 60B communicating with the air chambers 50A and 50B, suction fans 70*a* and 70B disposed below the ducts 60A and 60B, and suction motors 72A and 72B configured to rotate and drive the suction fans 70A and 70B, respectively.

A sheet transporting apparatus 100 mounted in the image forming apparatus includes the platen guide plate 30, the suction unit 40, the suction transport roller 36, the transport roller 80, the pressure roller 90 and the motors configured to rotate and drive the rollers.

The suction fans 70A and 70B are sirocco fans (blower fans), and function as a negative pressure generating units configured to discharge the air in the air chambers 50A and 50B downward through the ducts 60A and 60B, respectively, reduce the pressure in the air chambers 50A and 50B to a pressure lower than atmospheric pressure, and generate a negative pressure in the suction holes 32A and 32B of the platen guide plate 30.

Besides, the suction fans 70A and 70B are rotated and driven during printing by the recording head 20. Because of this, the sheet P is forced onto the sheet guide surface 31 on the platen guide plate 30 by the negative pressure generated in the air chambers 50A and 50B.

The sheet P is transported in an Xa direction by the rotation of the transport roller 80 and the pressure roller 90 disposed upstream of the platen guide plate 30. The sheet P is transported in the Xa direction until the leading edge (leading edge in the transport direction) of the sheet P reaches the downstream end of a target intermittent transport distance (transport distance set according to required image quality and printing speed). As a result of this, the sheet P reaches the print area A facing the recording head 20 is forced onto the sheet guide surface 31 of the platen guide plate 30 by the rotation of the suction fan 70A, and is held in the horizontal state. The carriage 10 starts to move linearly in the Y direction, and color inks are suitably ejected from the respective ink nozzles (not shown) of the recording head 20 to form an image on the surface of the sheet P.

Besides, the sheet P passing through the print area A is forced onto the sheet guide surface 31 of the platen guide plate 30 by the rotation of the suction fan 70B provided downstream of the print area A. As a result of this, even after being printed, the sheet P is forced onto the sheet guide surface 31 of the platen guide plate 30 and is held in the horizontal state. Further, a transporting force in the transport direction (Xa direction) is transmitted by the suction transport roller 36 provided downstream of the print area A.

A sheet detection sensor 230 configured to detect the passing of the sheet P is disposed at the downstream side of the suction transport roller 36. The sheet detection sensor 230 detects the sheet where a transporting force is transmitted by the suction transport roller 36 to the leading edge of the sheet P transported along the platen guide plate 30. The sheet detection sensor 230 outputs a detection signal to the controller 200 (See FIG. 4).

An encoder wheel 120 (see FIG. 1) and an encoder sensor 140 (see FIG. 4) are attached to a shaft extension part of the transport roller 80. The encoder wheel 120 and the encoder sensor 140 detect the rotation direction and rotation angle of the transport roller 80. Further, the transport roller 80 is rotated and driven in the clockwise direction or counterclockwise direction by a resistance motor 130 (see FIG. 4). The resistance motor 130 is, for example, a stepping motor, and can transport the sheet P, for example, 0.2 mm to 0.5 mm per pulse.

Besides, the rotation direction and the rotation amount (rotation angle) of the resistance motor 130 are controlled by the controller 200, so that the transport distance of the sheet transported by the transport roller 80 is adjusted to an arbitrary movement distance. In this embodiment, the suction unit 40 is stopped before the sheet P is transported to the print area A. The leading edge of the sheet P is transported by a specified distance obtained by adding a surplus extended distance to the target intermittent transport distance (which varies according to the required image quality and printing speed). Thereafter, the rotation direction and the rotation amount (rotation angle) of the transport roller 80 are adjusted so that the sheet P is moved in the reverse direction (Xb direction) and is returned so that the sheet leading edge is located at the downstream end of the target intermittent transport distance while the sheet P is held on the sheet guide surface 31 of the platen guide plate 30 by the suction force of the suction fans 70A and 70B. As a result of this, in the print area A, the sheet P can be brought into close contact with the sheet guide surface 31 of the platen guide plate 30 so that the curl (loop) does not occur in the sheet P, and the planar precision (horizontal state) of the surface of the sheet P can be ensured.

Figure 3:
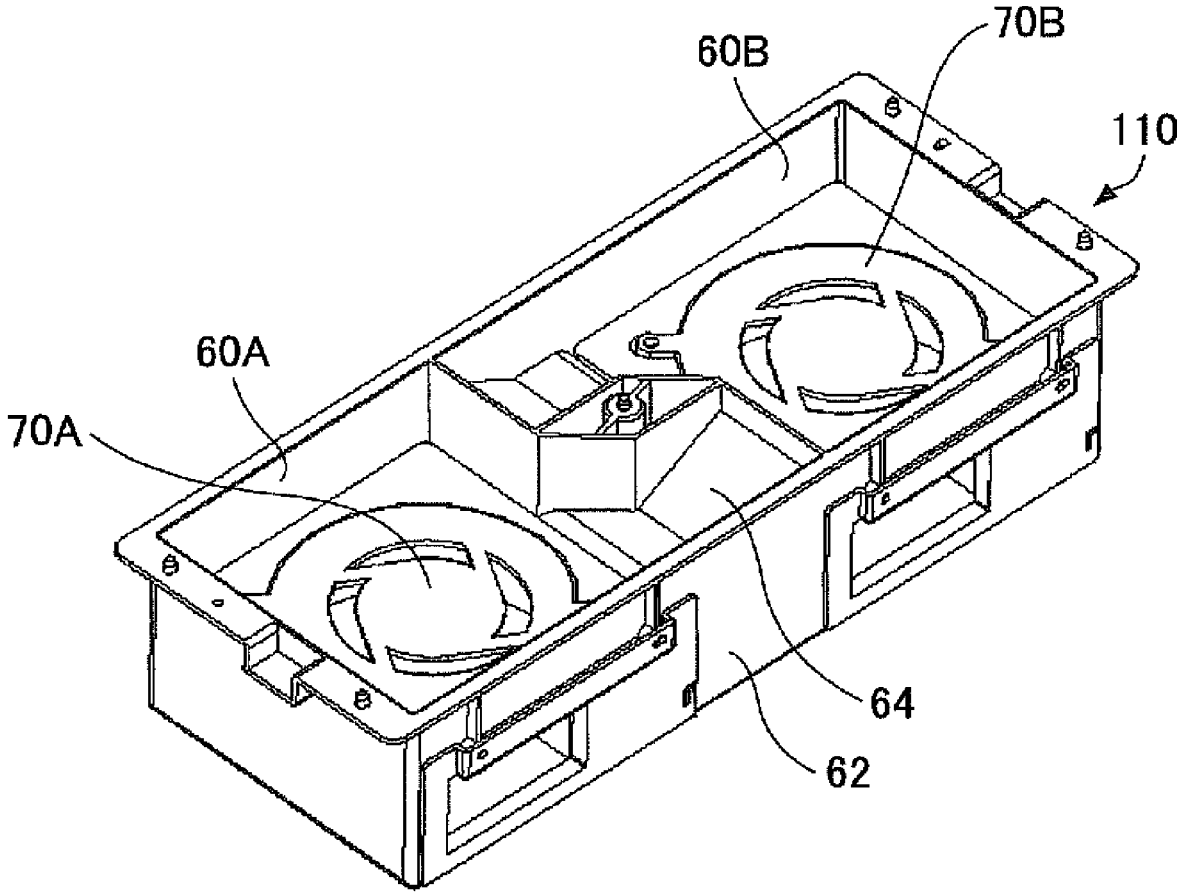
FIG. 3 is a perspective view showing a suction motor unit.

FIG. 3 is a perspective view showing a suction motor unit. As shown in FIG. 3, in a suction motor unit 110, the inside of a housing 62 is partitioned by a partition section 64 into the ducts 60A and 60B. The suction fans 70A and 70B and the suction motors 72A and 72B are incorporated in the bottoms of the ducts 60A and 60B, respectively. Accordingly, the air chambers 50A and 50B individually communicate with the ducts 60A and 60B and are respectively evacuated by the suction fans 70A and 70B.

Figure 4:
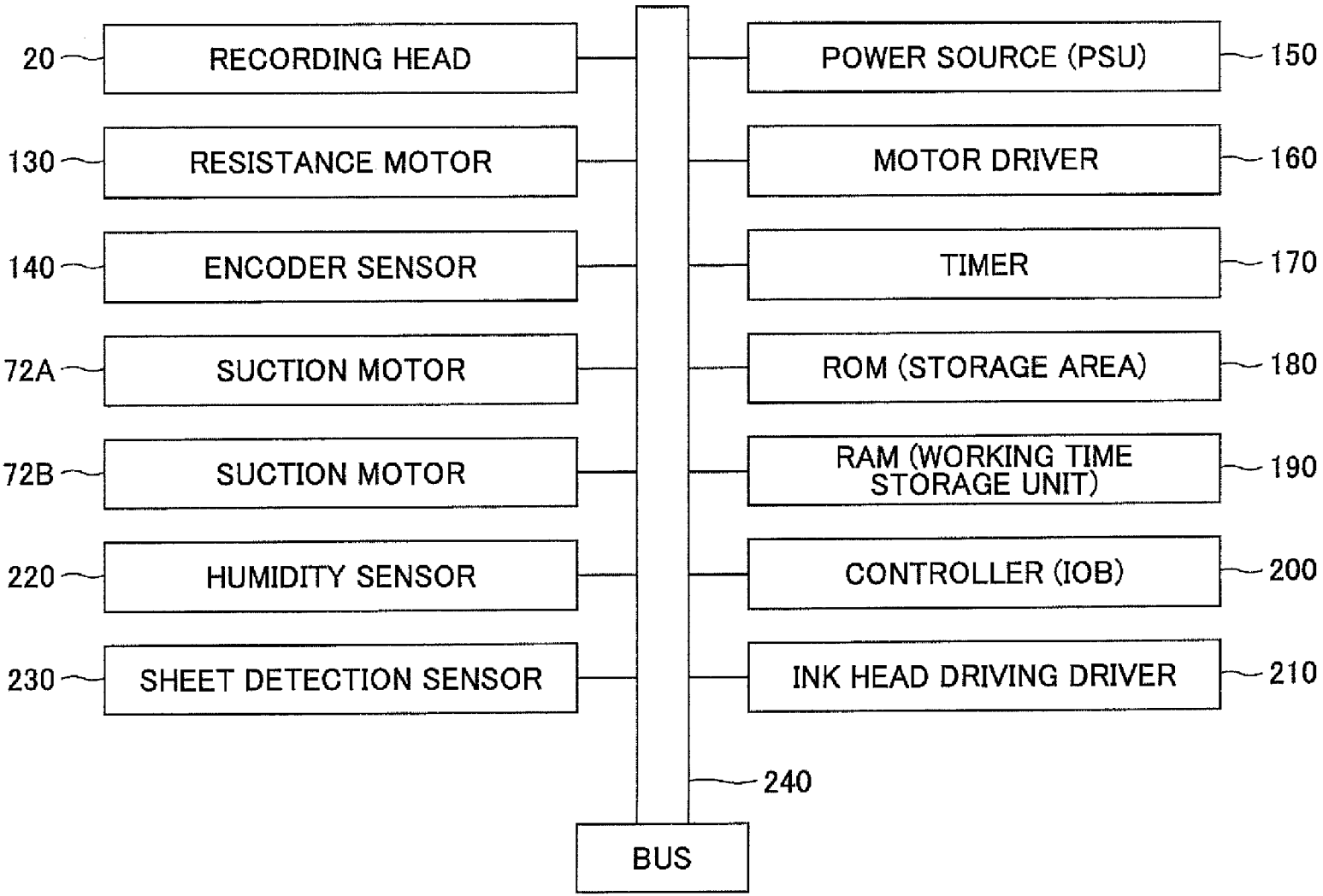
FIG. 4 is a block diagram showing the sections constituting the image forming apparatus.

FIG. 4 is a block diagram showing the sections constituting the image forming apparatus. As shown in FIG. 4, the image forming apparatus includes the resistance motor 130, the encoder sensor 140, a power source 150, a motor driver 160, a timer 170, a ROM (Read-Only Memory) 180, a RAM (Random Access Memory) 190, a controller (control unit) 200, an ink head driving driver 210, a humidity sensor 220, and the sheet detection sensor 230 in addition to the recording head 20 and the suction motors 72A and 72B. The sections are connected to each other through a bus 240. The controller 200 loads a control program stored in the ROM 180 in the RAM 190, and drives and controls the suction motors 72A and 72B and the resistance motor 130. The ink head driving driver 210 pressurizes and controls the ink nozzles of the recording head 20 to print inputted image data onto the sheet P.

The humidity sensor 220 detects the humidity of air, and outputs a humidity detection signal corresponding to the humidity to the controller 200.

Here, a basic cooperative operation between the sheet transported by the sheet transporting apparatus 100 at the time of printing and the sheet suctioned by the suction unit 40 is discussed.

Figure 5A:
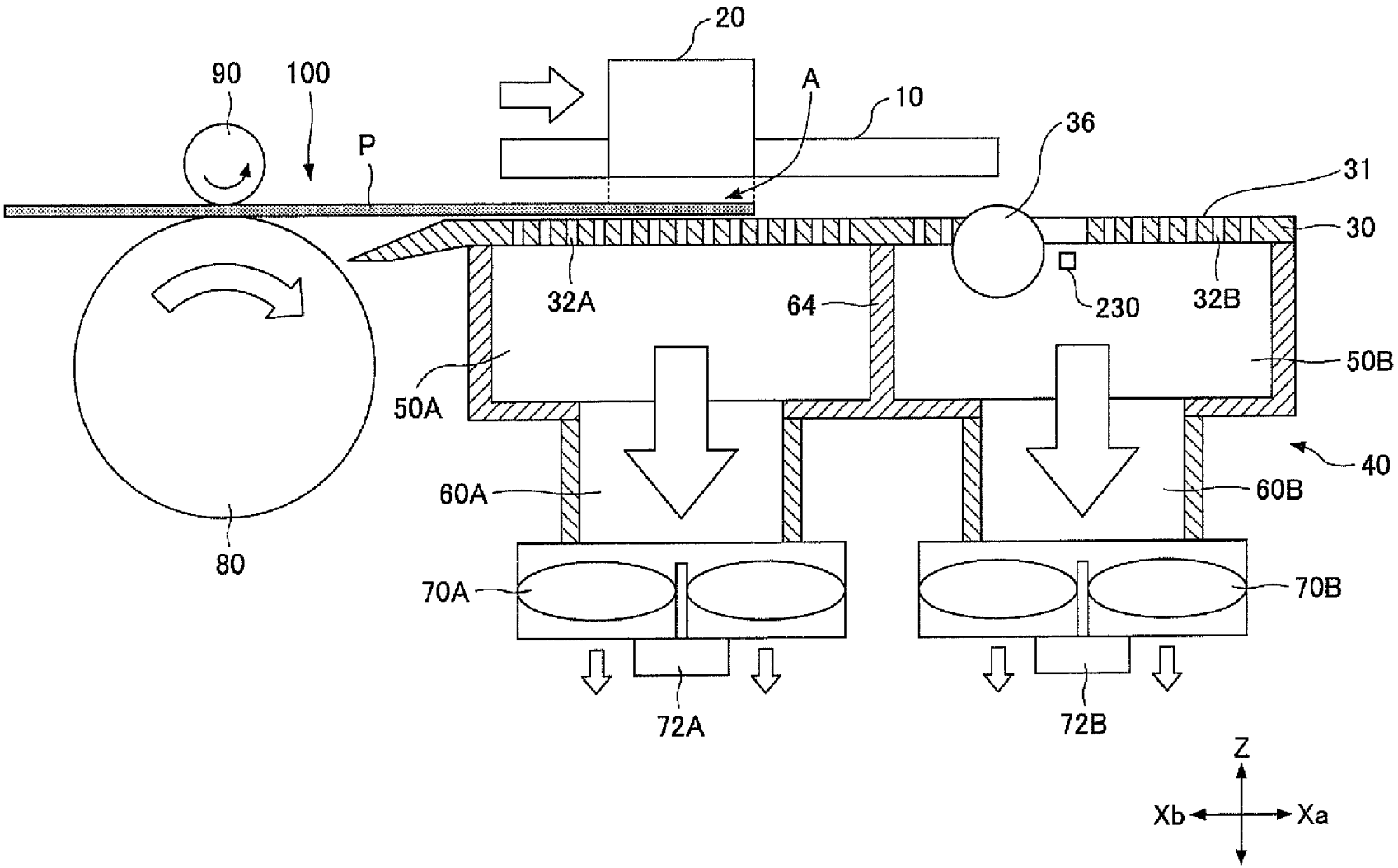
FIG. 5A is a view showing where a sheet P is transported an intermittent transport distance.

FIG. 5A is a view showing where the sheet P is transported the intermittent transport distance. As shown in FIG. 5A, the sheet P is transported by the rotation of the transport roller 80 and the pressure roller 90 along the sheet guide surface 31 of the platen guide plate 30. When the leading edge of the sheet P has traveled the intermittent transport distance (to print area A), or just before printing is started, the suction fans 70A and 70B are rotated and driven so that the air of the air chambers 50A and 50B is discharged downward. As a result of this, since the pressures of the air chambers 50A and 50B are reduced (negative pressure) to be lower than atmospheric pressure, the sheet P is forced downward against the suction holes 32A and 32B. The sheet P is held on the sheet guide surface 31 formed on the upper surface of the platen guide plate 30.

When the leading edge of the sheet P is stopped after traveling the intermittent transport distance, the carriage 10 starts to move linearly in the Y direction, and ink is ejected from the nozzles (not shown) of the recording head 20 to form an image on the surface of the sheet P. Thus, at the time of printing, the distance (interval) between the recording head 20 and the sheet P is kept constant, and the printing precision and the quality of the printed image can be ensured to be high.

Besides, while the carriage 10 is moved in the Y direction, the transport of the sheet E is stopped. While the carriage 10 is reversed at both ends of the reciprocating movement, the transport roller 80 intermittently transports the sheet P.

Figure 5B:
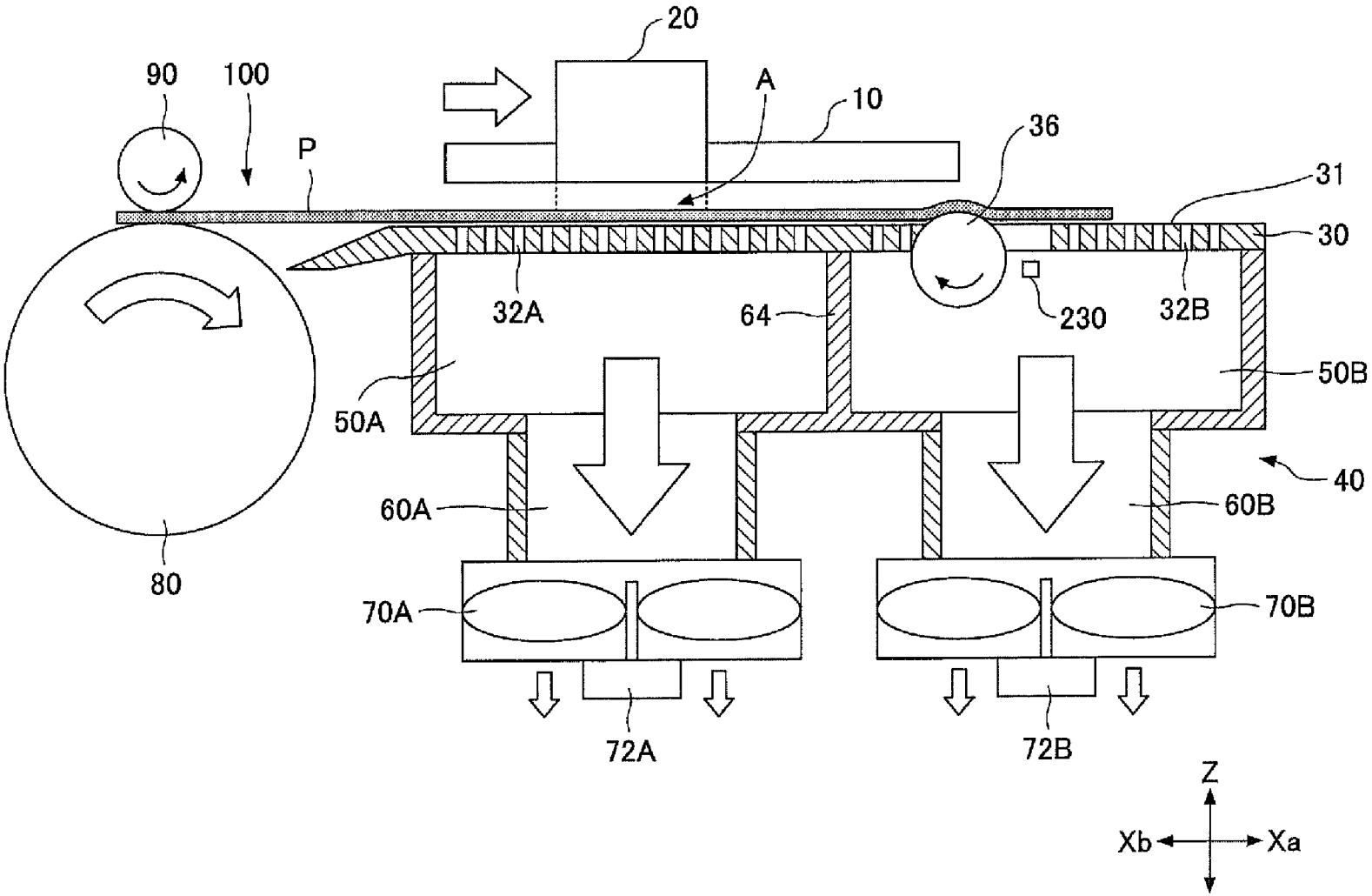
FIG. 5B is a view showing where the sheet P reaches a suction transport roller 36 after the start of printing.

FIG. 5B is a view showing where the sheet P reaches the suction transport roller 36 after printing is started. As shown in FIG. 5B, the sheet P is pressed onto the suction transport roller 36 by the negative pressure generated by the rotation of the suction fans 70A and 70B. Thus, when the suction transport roller 36 rotates, the transporting force acting on the sheet P can be obtained even at the downstream side of the print area. Incidentally, the suction transport roller 36 is disposed so as to come in contact with the lower surface side of the sheet P. An opposite roller is not disposed at the print side (the upper surface side) of the sheet P, because there is a high probability that the ink will have not yet dried just after the printing.

Besides, although not shown, there is also an image forming apparatus where, in order to reduce the influence on the image surface, a spur (thin metal gear which comes in point contact with the sheet) is, at the further downstream side, brought into contact with the sheet to obtain the transporting force.

Figure 6A:
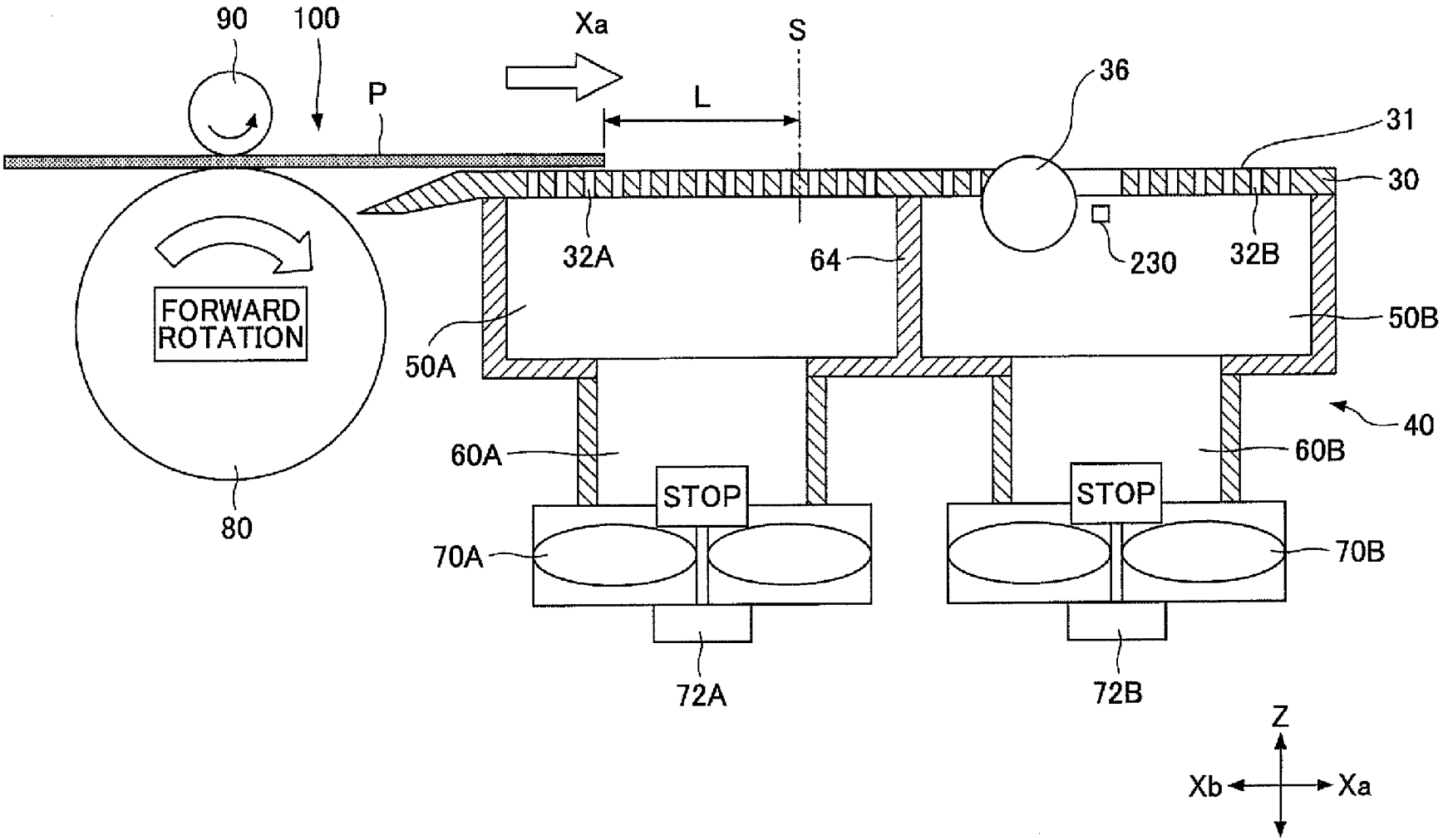
FIG. 6A is a view showing where the sheet P is transported to a platen guide plate 30.
Figure 6B:
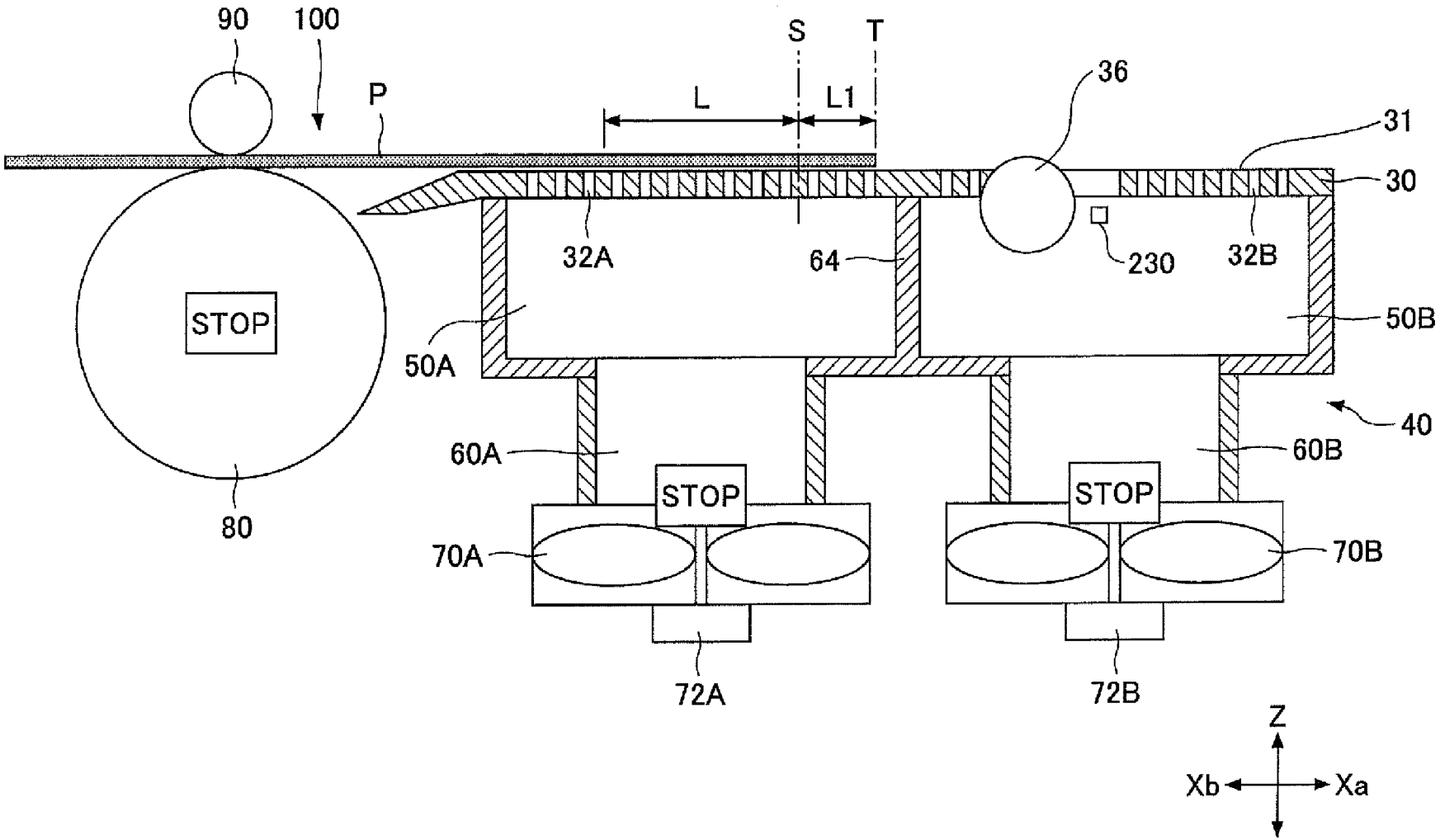
FIG. 6B is a view showing where a leading edge of the sheet P is moved from an intermittent transport distance L by an extended distance L1 and is then stopped.
Figure 6C:
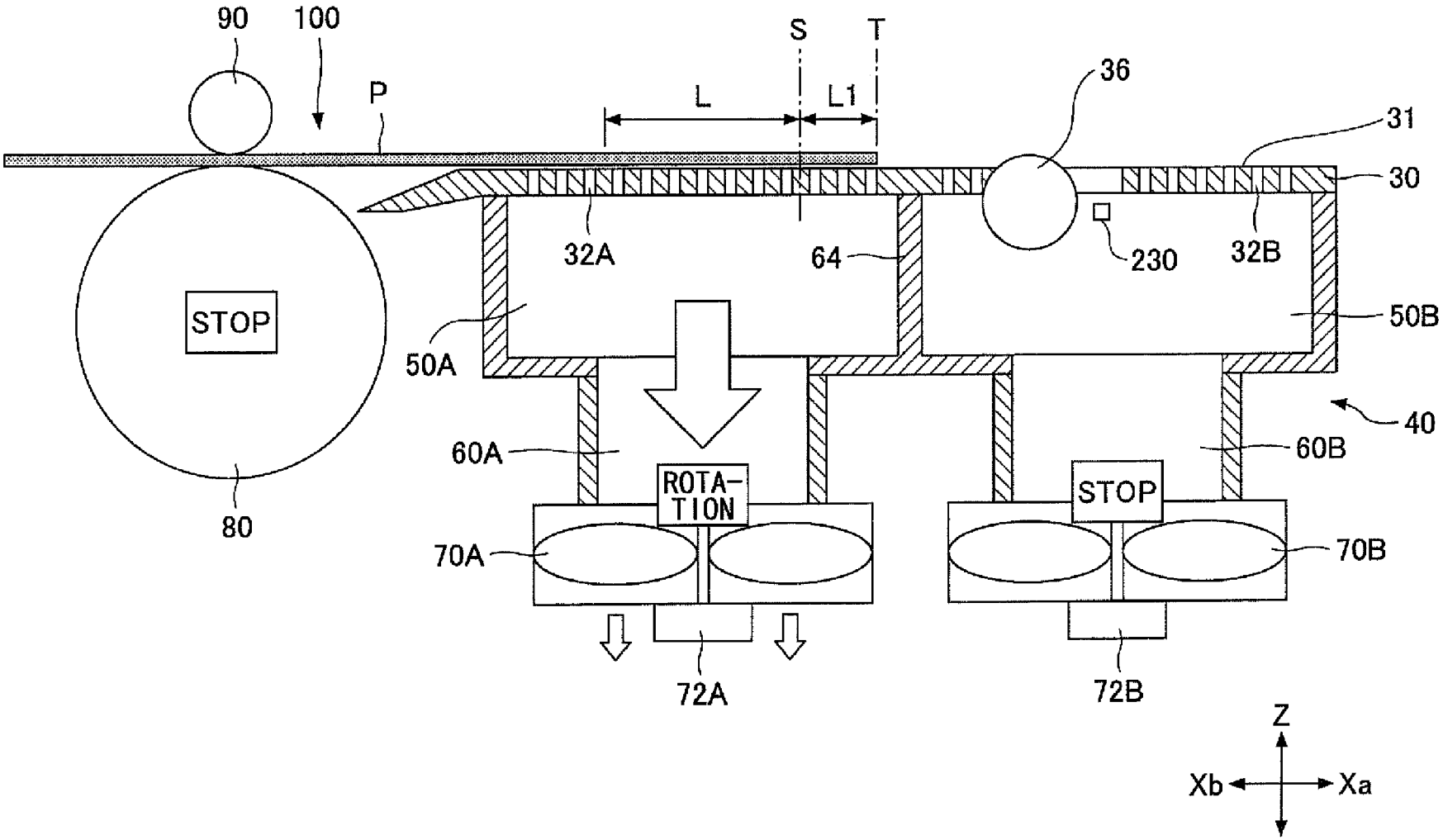
FIG. 6C is a view showing where the sheet P is held by a suction force.
Figure 6D:
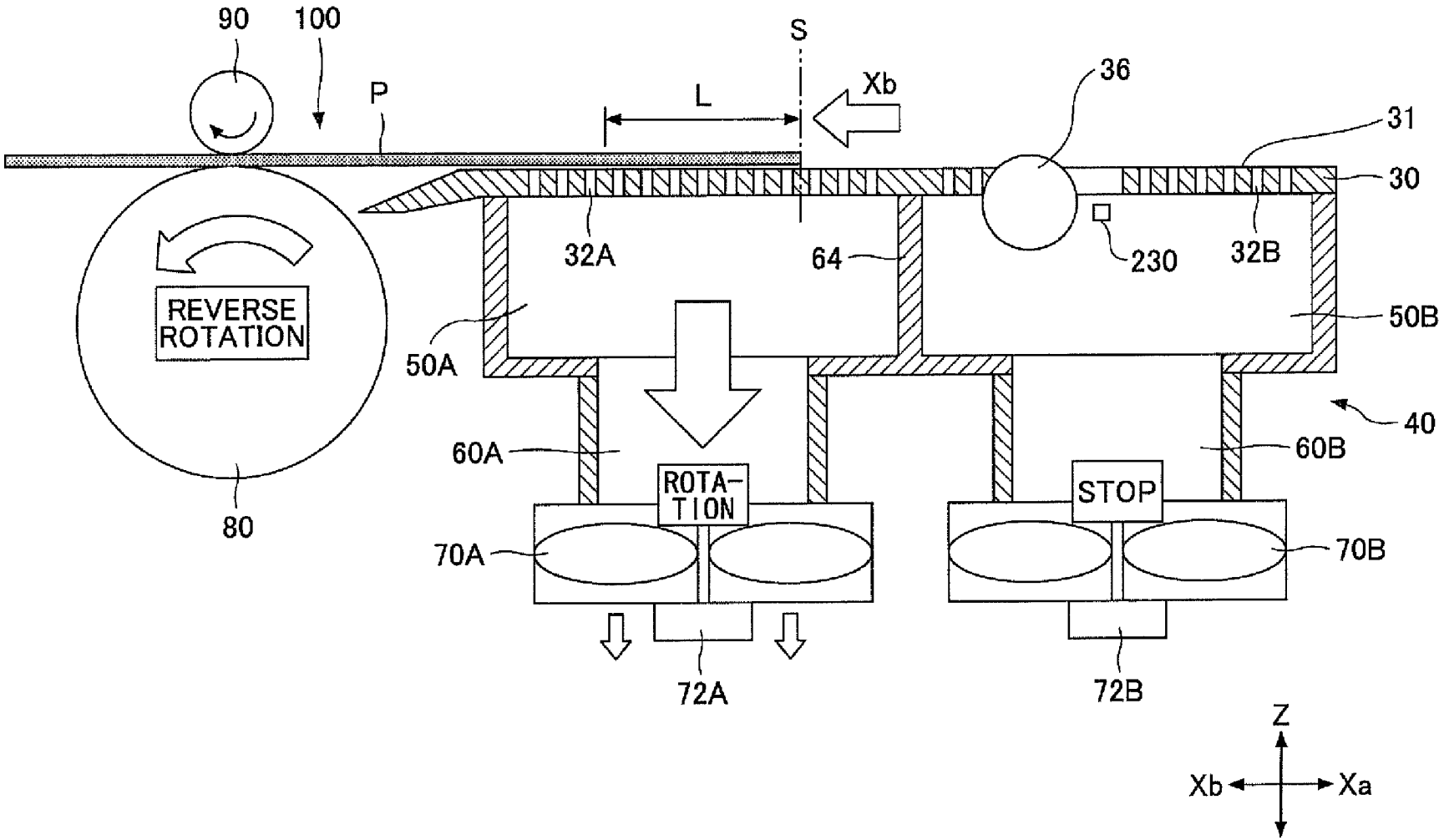
FIG. 6D is a view showing where the sheet P is transported in a reverse direction and is returned to the intermittent transport distance.

Here, a transporting method of the sheet P by the sheet transporting apparatus 100 is described in time series with reference to FIGS. 6A through 6D. FIG. 6A is a view showing where the sheet P is being transported onto the platen guide plate 30. FIG. 6B is a view showing where the leading edge of the sheet P is moved an extended distance L1 in addition to an intermittent transport distance L and is stopped. FIG. 6C is a view showing where the sheet P is being suctioned. FIG. 6D is a view showing where the sheet P is transported in the reverse direction and is returned so that the sheet leading edge is located at the downstream end of the intermittent transport distance.

As shown in FIG. 6A, the sheet P is transported in the forward direction (Xa direction) by the rotation of the transport roller 80 and the pressure roller 90 in the forward direction. During this sheet transport, both the suction fans 70A and 70B are stopped, and the sheet P is not forced onto the platen guide plate 30.

As shown in FIG. 6B, the sheet P is transported so that the leading edge of the sheet P moves by the intermittent transport distance L, passes through a print start position S, and reaches a specified position T=(L+L1 movement) obtained by adding the extended distance L1.

That is, when the leading edge of the sheet P moves by the intermittent transport distance L and the extended distance L1 and reaches the stop position T, the transport roller 80 is stopped, and the transport of the sheet P is stopped. Since the suction fan 70A is still stopped at this time point, the sheet P is not forced onto the platen guide plate 30.

Although the extended distance L1 through which the sheet is further transported from the intermittent transport distance L may be an arbitrary distance, the distance must be such that the curl (loop) of the sheet P generated between the transport roller 80 and the platen guide plate 30 can be removed. Besides, it is general practice that plural intermittent transport distances L are set according to the required image quality and printing speed (productivity). For example, when top priority is given to the printing speed, the transport distance of the sheet P is often made large by the length (head length) of the recording head in the paper transport direction and printing is performed in one carriage movement.

On the other hand, when priority is given to the image quality, printing for the length of the recording head is performed in plural carriage movements and by more precise ink ejection. Thus, the intermittent transport distance L of the sheet P is often a distance of about ½, ¼, ⅛, 1/16 or 1/32 of the length of the recording head.

Besides, in the inkjet recording system, it is general practice that the resolution is improved by transporting the sheet P by a distance of half of a nozzle interval (nozzle pitch) formed on the recording head 20. In this case, for example, even when the nozzle pitch is 1/150 inch, sheet transporting is performed every 1/300 inch, so that the resolution in the sub-scanning direction can be improved to 300 dpi (dots per inch).

As shown in FIG. 6C, after the transport roller 80 is completely stopped, the suction motor 72A located at the upstream side is driven to start the rotation of the suction fan 70A. A standby time is required from the start of the suction fan 70A to the stabilization of the negative pressure in the air chamber 50A. The negative pressure stabilization time varies according to the performance (static pressure, flow amount, startup time, etc.) of the suction fan 70A.

As shown in FIG. 6D, after the negative pressure in the air chamber 50A located at the upstream side is stabilized, the transport roller 80 is rotated and driven in the reverse direction (counterclockwise direction). As a result of this, the reverse transport (transport in the Xb direction) of the sheet P is started by the transport roller 80 and the pressure roller 90. With respect to the resistance (suction force holding the sheet P onto the platen guide plate 30 produced by the suction unit 40) of the sheet P, the acting direction (Xb direction) of the transporting force by the transport roller 80 is the pulling direction. Thus, the leading edge of the sheet P is brought into close contact with the sheet guide surface 31 of the platen guide plate 30, so that the occurrence of the curl (loop) can be prevented. Hence, the plane precision of the surface of the sheet P can be ensured.

When the leading edge of the sheet P is returned in the reverse direction (Xb direction) by the extended distance L1, the transport roller 80 is stopped. As a result of this, an error between the rotation angle of the transport roller 80, which is recognized and controlled by feeding back the transport amount obtained by the encoder wheel 120 and the encoder sensor 140, and the position of the sheet P becomes small. Hence, the transport precision of the sheet P can be raised. Besides, when the forward transport and the reverse transport of the sheet P according to the embodiment are performed at the time of printing, it becomes unnecessary to provide the standby time for removing the curl (loop) during the printing. Thus, the time required for the printing is shortened, and the printing efficiency (productivity) can be improved.

Next, a control process 1 executed by the controller 200 mounted in the image forming apparatus is described with reference to flowcharts of FIG. 7A and FIG. 7B.

Figure 7A:
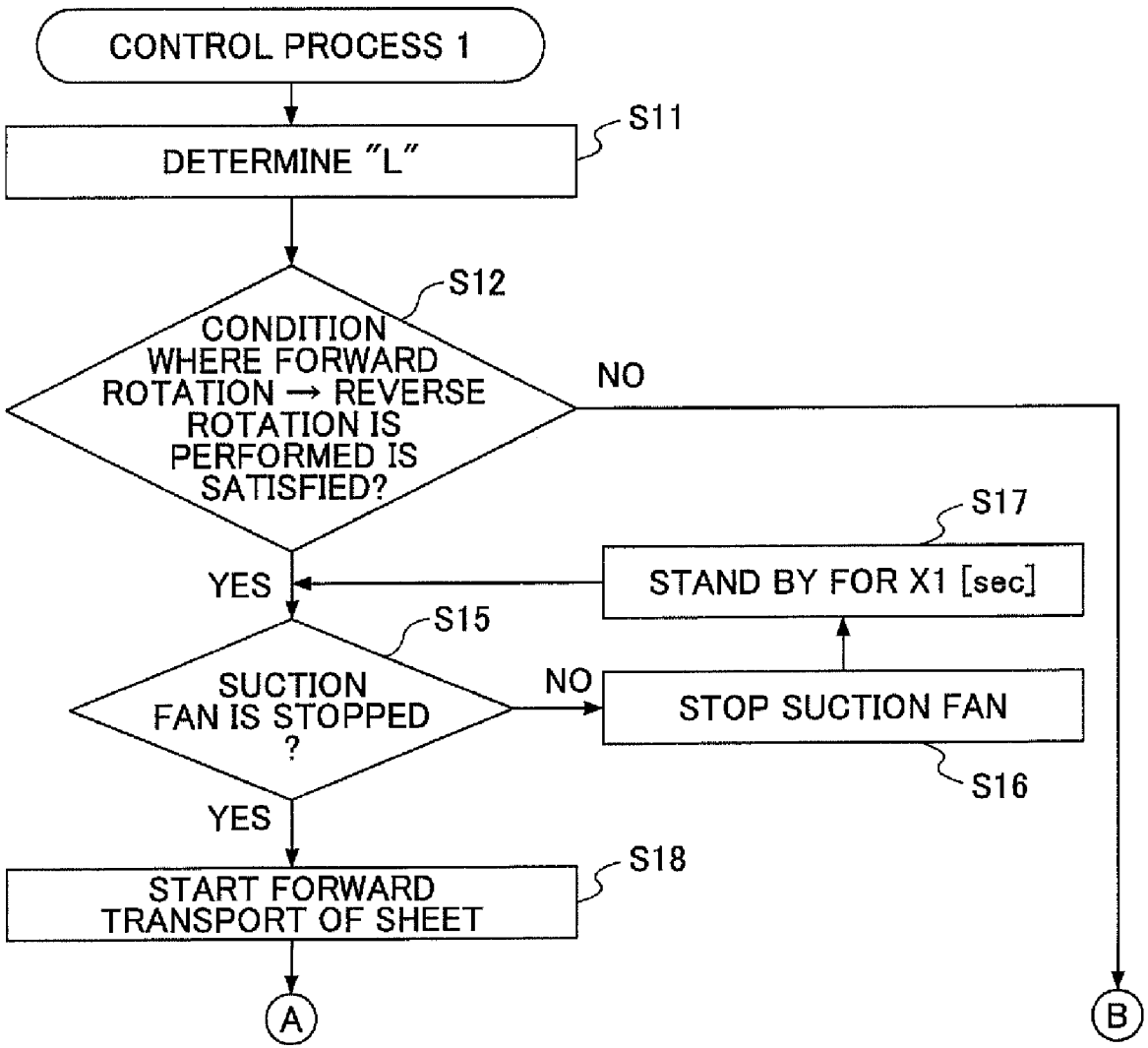
FIG. 7A is a first flowchart for explaining a control process 1 executed by a controller 200.

The controller 200 determines the target transport distance L based on a print job (including an image quality and printing speed) inputted in S11 of FIG. 7A. Next, in S12 (process corresponding to claim 2), it is determined whether a condition of a transport method where the transport direction of the sheet P is changed from the forward direction (Xa direction) to the reverse direction (Xb direction) is satisfied (whether an environment is such that a curl (loop) is likely to occur in the sheet P). In S12, when the condition of the transport method where the transport direction of the sheet P is changed from the forward direction to the reverse direction is not satisfied (the environment is not such that the curl (loop) is likely to occur in the sheet P), the process goes to S13. The transport roller 80 is forward rotated (rotation in the clockwise direction) and starts to transport the sheet P in the forward direction (Xa direction).

In S14, it is determined whether the forward transport by the transport roller 80 is completed. In S14, a transport amount detection pulse detected by the encoder sensor 140 is accumulated and when the leading edge of the sheet P is transported by the transport distance L, it is determined that the leading edge of the sheet P reaches the print start position S. Hence, it is determined that the forward transport by the transport roller 80 is completed so that the transport roller 80 is stopped. Thereafter, the process goes to S24, so that the carriage starts to move linearly in the Y direction. The ink is ejected from the nozzles (not shown) of the recording head 20 to start image formation on the surface of the sheet P.

Besides, in S12, when the condition of the transport method where the transport direction of the sheet P is changed from the forward direction (Xa direction) to the reverse direction (Xb direction) is satisfied (when the environment is such that the curl (loop) is likely to occur in the sheet P), the process goes to S15. In S15, a signal (lock detection signal, rotation signal, etc.) from the suction motor 72A to drive the suction fan 70A is read, and it is determined whether the rotation of the suction fan 70A is stopped. In S15, when the suction fan 70A is rotated, the process goes to S16. In S16, driving of the suction motor 72A to drive the suction fan 70A is stopped. The process is in standby until a specified time of X1 seconds (time required for the negative pressure of the air chamber 50A to be returned to atmospheric pressure) is counted by the timer 170 in S17, and the process returns to S15.

In S15, when the suction fan 70A is stopped, the process goes to S18 and the resistance motor 130 is driven to rotate and drive the transport roller 80 in the forward direction (clockwise direction), so that the forward transport of the sheet P is started.

Next, in S19, it is determined whether the transport of the leading edge of the sheet P to the stop position T (see FIG. 6B), where the distance is longer than the transport distance L by the extended distance L1, is completed. In S19, as a result of integrating the transport amount detection pulses detected by the encoder sensor 140, when the leading edge of the sheet P reaches the stop position T where the distance is longer than the transport distance L by the extended distance L1, the process goes to S20, the transport roller 80 is stopped, and the suction motor 72A is driven to rotate the suction fan 70A (see FIG. 6C).

Next, in S21, the process is in standby until the timer 170 counts a specified time of X2 seconds (time required for the negative pressure of the air chamber 50A to be returned to atmospheric pressure). Next, in S22, the transport roller 80 is rotated and driven in the reverse direction (counterclockwise direction) to start the reverse transport (transport in the Xb direction) of the sheet P. Then, in S23, it is determined whether the reverse transport is completed. In S23, as a result of integrating the transport amount detection pulses obtained by the encoder sensor 140, when the leading edge of the sheet P is returned by the extended distance L1 and reaches the print start position S (see FIG. 6D), it is determined that the reverse transport is completed, and the transport roller 80 is stopped.

Next, in S24, the carriage 10 starts to move linearly in the Y direction, and ink is ejected from the nozzles (not shown) of the recording head 20 to start image formation on the surface of the sheet P.

As stated above, when the controller 200 executes the control process 1, after the sheet P is transported in the forward direction (Xa direction), the suction fan 70A is rotated, and while the sheet P is forced onto the platen guide plate 30, the sheet is transported in the reverse direction (Xb direction) to remove the curl (loop) of the sheet P. Printing by the recording head 20 is started when the plane precision of the sheet P is ensured. Thus, the sheet P is prevented from contacting the nozzle surface of the recording head 20, so that the nozzle surface of the head and the sheet are not soiled. Besides, the image quality is improved and the printing precision is further raised, so that the reliability of the precise printing can be raised.

Figure 7B:
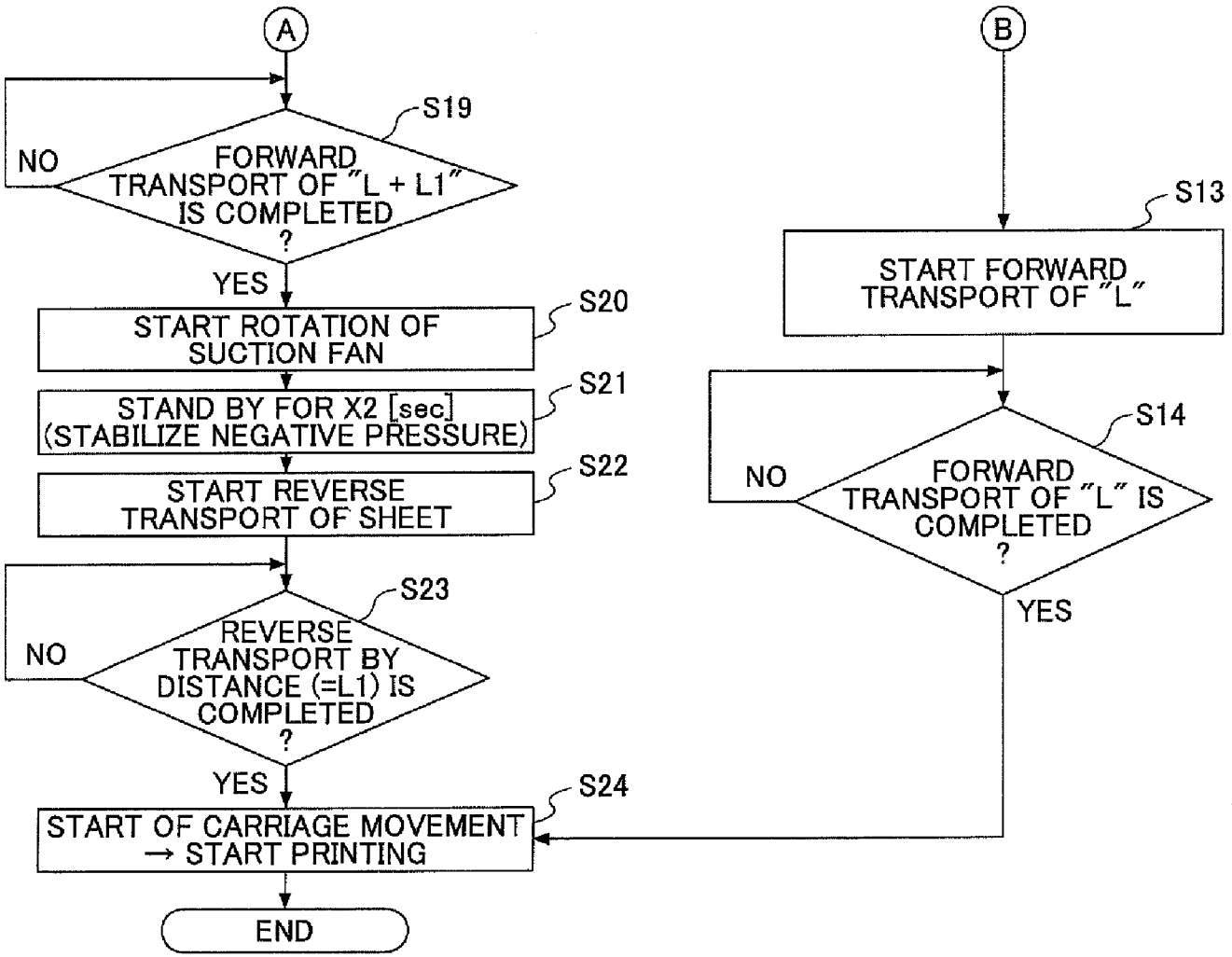
FIG. 7B is a second flowchart for explaining the control process 1 executed by the controller 200.

In the control process 1 of FIG. 7A and FIG. 7B, although the example is described in which the forward transport and the reverse transport of the sheet P performed at S18 to S23 are executed only one time, they may be performed plural times.

Here, a modified example of the control process executed by the controller 200 is described.

Figure 8A:
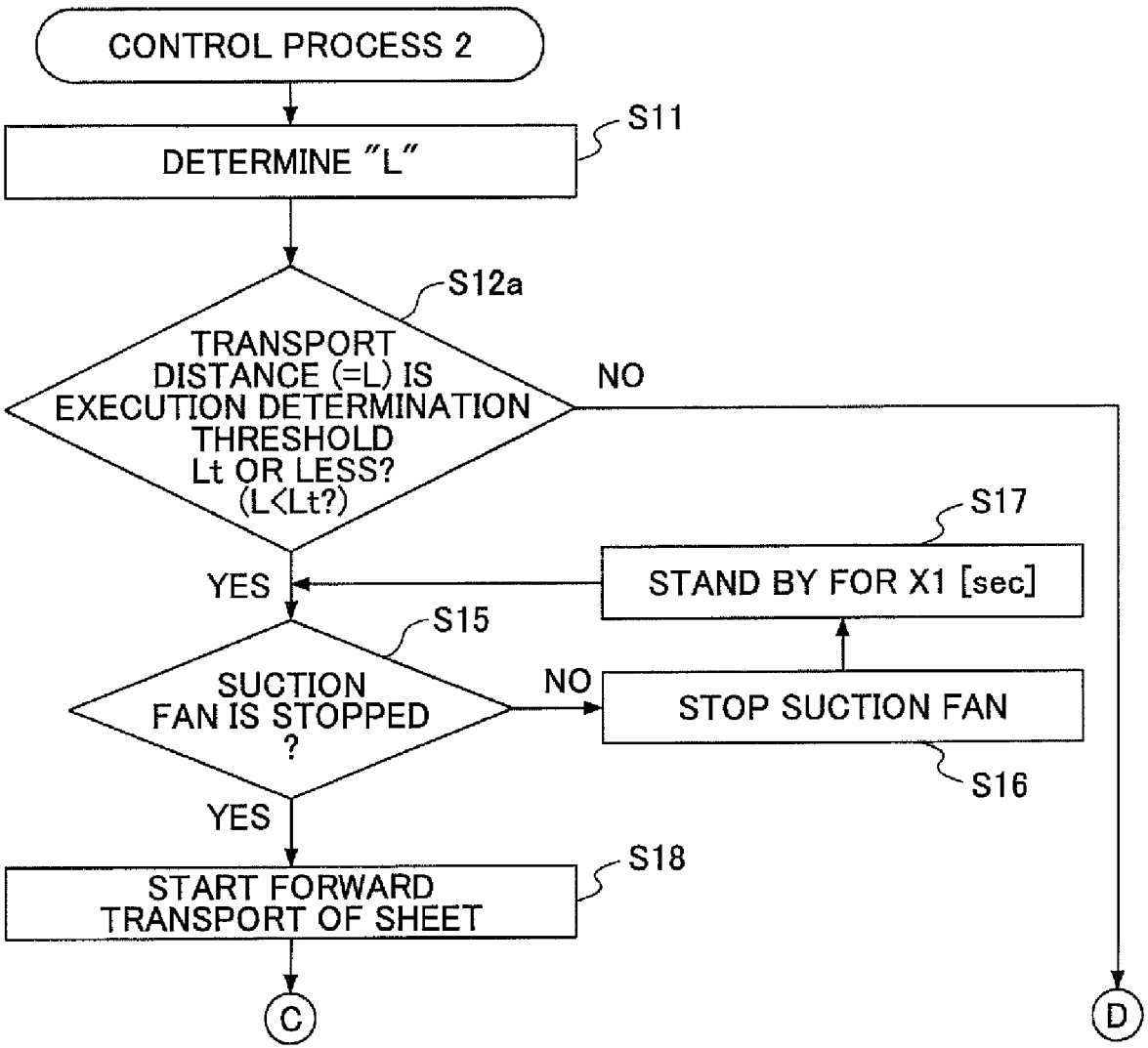
FIG. 8A is a first flowchart for explaining a control process 2 executed by the controller 200.
Figure 8B:
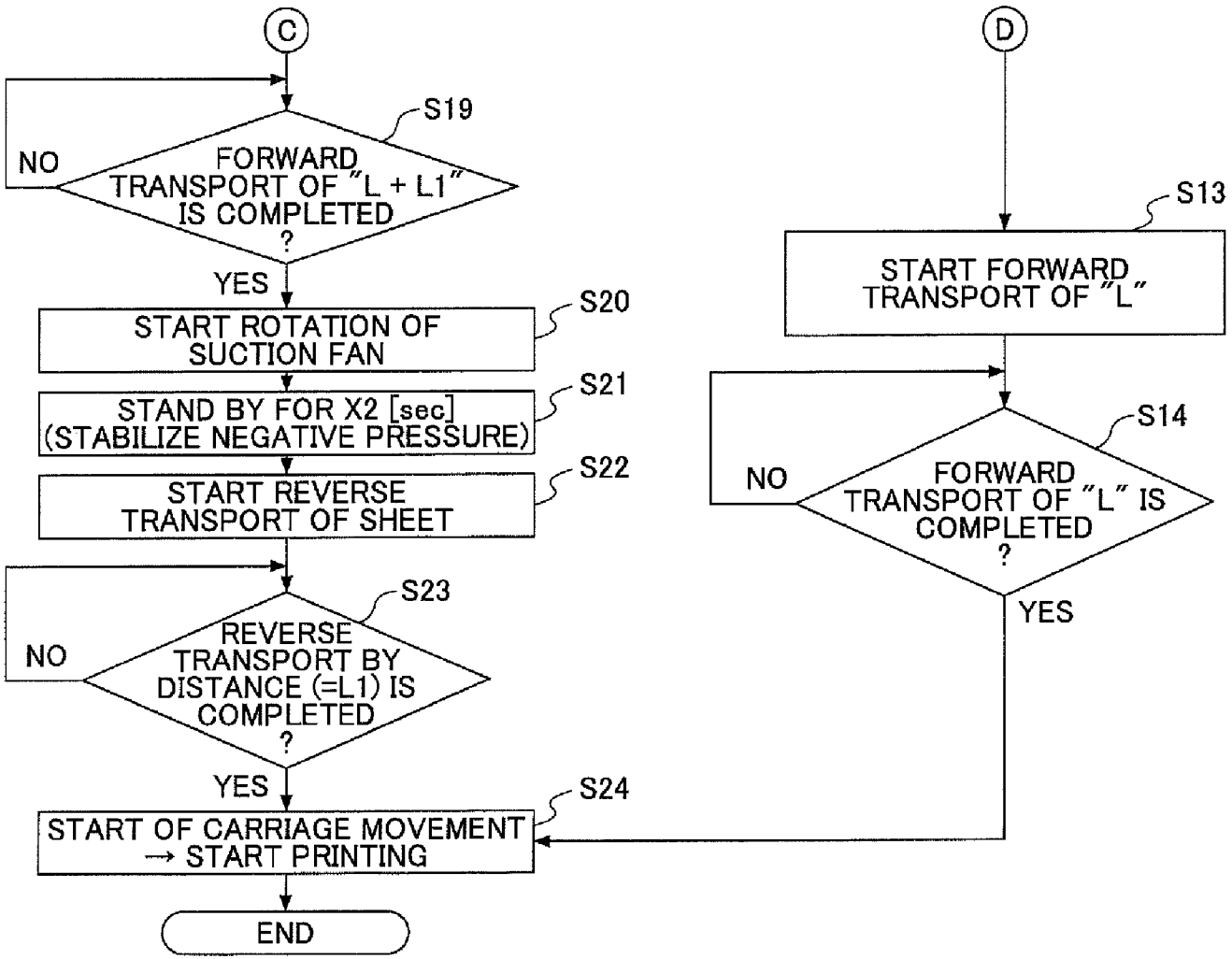
FIG. 8B is a second flowchart for explaining the control process 2 executed by the controller 200.

FIG. 8A and 8B are flowcharts for explaining a control process 2 executed by the controller 200. In FIG. 8A and FIG. 8B, the same process as the process of FIG. 7A and FIG. 7B is denoted by the same reference numerals and its explanation is omitted.

In S12*a* (process corresponding to claim 3) of FIG. 8, as a condition of a transport method where the transport direction of the sheet P is changed from the forward direction (Xa direction) to the reverse direction (Xb direction), it is determined whether the intermittent transport distance L of the sheet P is equal to or less than an execution determination threshold Lt. The threshold Lt is a value set and registered, in advance, in the ROM 180 at the time of shipment or a value arbitrarily and subsequently set and registered at a user's request.

In S12*a*, when the transport distance L of the sheet P exceeds the execution determination threshold Lt, since the printed image quality is of normal image quality or the printing speed is a normal printing speed, the process goes to S13. The transport roller 80 is forward rotated (rotated in the clockwise direction), so that the transport of the sheet P in the Xa direction is started. In the control process after this, since S13, S14 and S24 are executed similarly to the case of FIG. 7A and FIG. 7B, its explanation is omitted.

Besides, in S12*a*, when the transport distance L of the sheet P is equal to or less than the execution determination threshold Lt, since the printed image quality is of high image quality or the printing speed is a high printing speed, the forward transport and the reverse transport of S18 through S24 are performed.

As stated above, when the controller 200 executes the control process 2, and when the intermittent transport distance L is equal to or less than the threshold Lt, after the sheet P is transported in the forward direction (Xa direction), the suction fan 70A is rotated, and while the sheet P is forced onto the platen guide plate 30, the sheet is transported in the reverse direction (Xb direction) to remove the curl (loop) of the sheet P. Printing by the recording head 20 is started when the plane precision of the sheet P is ensured. Thus, the sheet P is prevented from contacting the nozzle surface of the recording head 20, so that the nozzle surface of the head and the sheet are not soiled. Besides, the image quality is improved and the printing precision is further raised, so that the reliability of the precise printing can be raised.

In the control process 2 of FIG. 8A and FIG. 8B, although the example is described in which the forward transport and the reverse transport of the sheet P performed at S18 to S23 are executed only one time, they may be performed plural times.

Figure 9A:
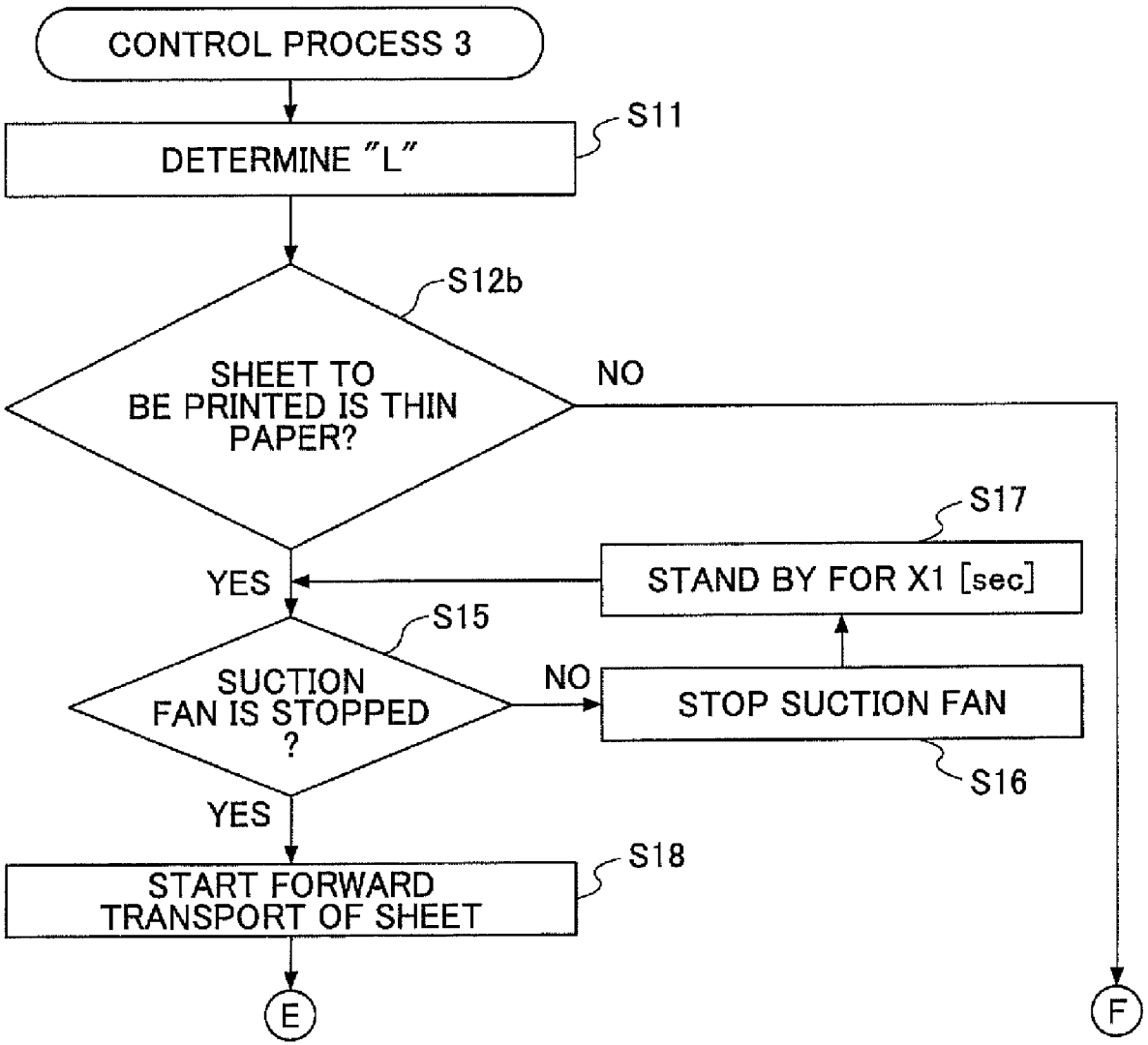
FIG. 9A is a first flowchart for explaining a control process 3 executed by the controller 200.
Figure 9B:
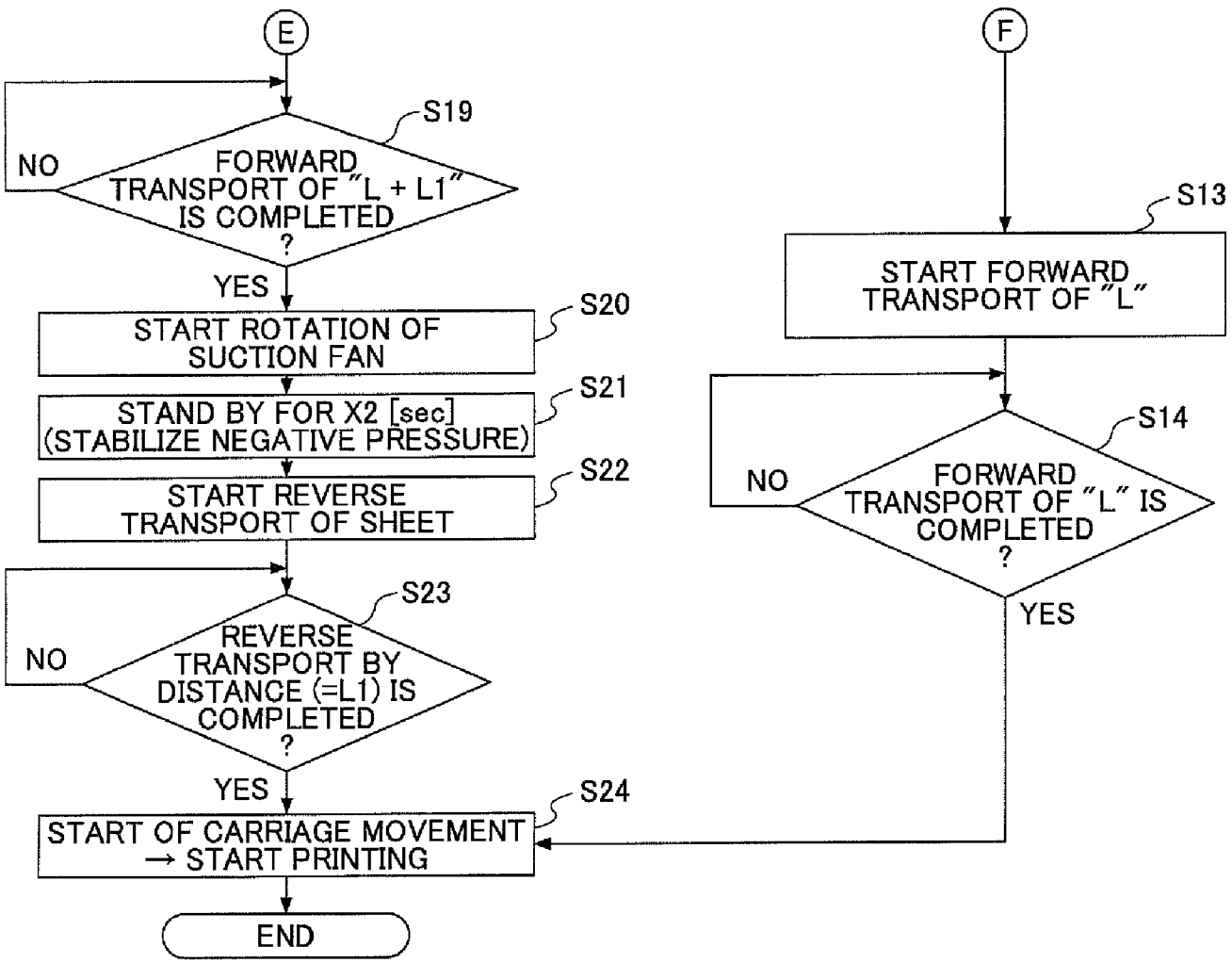
FIG. 9B is a second flowchart for explaining the control process 3 executed by the controller 200.

FIG. 9A and FIG. 9B are flowcharts for explaining a control process 3 executed by the controller 200. In FIG. 9A and FIG. 9B, the same process as the process of FIG. 7A and FIG. 7B is denoted by the same reference numerals and its explanation is omitted.

At S12*b* (process corresponding to claim 4) of FIG. 9A, as a condition of a transport method where the transport direction of the sheet P is changed from the forward direction (Xa direction) to the reverse direction (Xb direction), it is determined whether the paper thickness according to the type of the sheet P inputted in a print job is equal to or less than a threshold (for example, the thickness is equal to or less than 0.1 mm).

In S12*b*, when the thickness of the sheet P is greater than the threshold, since the thickness of the sheet P to be printed indicates a thick paper in which a curl (loop) does not easily occur, the process goes to S13. The transport roller 80 is forward rotated (rotation in the clockwise direction), so that the transport of the sheet P in the Xa direction is started. In a control process after this, since S13, S14 and S24 are executed similarly to the case of FIG. 7A and FIG. 7B, its explanation is omitted.

In S12*b*, when the thickness of the sheet P is equal to or less than the threshold, since the thickness of the sheet P indicates a thin paper in which a curl (loop) is likely to occur, the forward transport and the reverse transport of S18 through S24 are performed. Here, the "thin paper" whose thickness is determined to be equal to or less than the threshold means that the thin paper whose stiffness (rigidity) generally determined by the paper quality is low, and a loop is likely to occur. More specifically, there is a method executed only one time in which among types of printable sheets, information on paper types classified as "thin paper" is stored in the ROM 180, or a sensor to detect the paper thickness is used to detect the thickness of the sheet P, and it is determined based on the information whether the sheet is "thin paper".

As stated above, when the controller 200 executes the control process 3, and when the sheet P is a thin paper whose thickness is equal to or less than the threshold, after the sheet P is transported in the forward direction (Xa direction), the suction fan 70A is rotated, and while the sheet P is forced onto the platen guide plate 30, the sheet is transported in the reverse direction (Xb direction) to remove the curl (loop) of the sheet P. Printing by the recording head 20 is started when the plane precision of the sheet P is ensured. Thus, the sheet P is prevented from contacting the nozzle surface of the recording head 20, so that the nozzle surface of the head and the sheet are not soiled. Besides, the image quality is improved and the printing precision is further raised, so that the reliability of the precise printing can be raised.

In the control process 3 of FIG. 9A and FIG. 9B, although the example is described in which the forward transport and the reverse transport of the sheet P performed at S18 to S23 are executed only one time, they may be performed plural times.

Figure 10A:
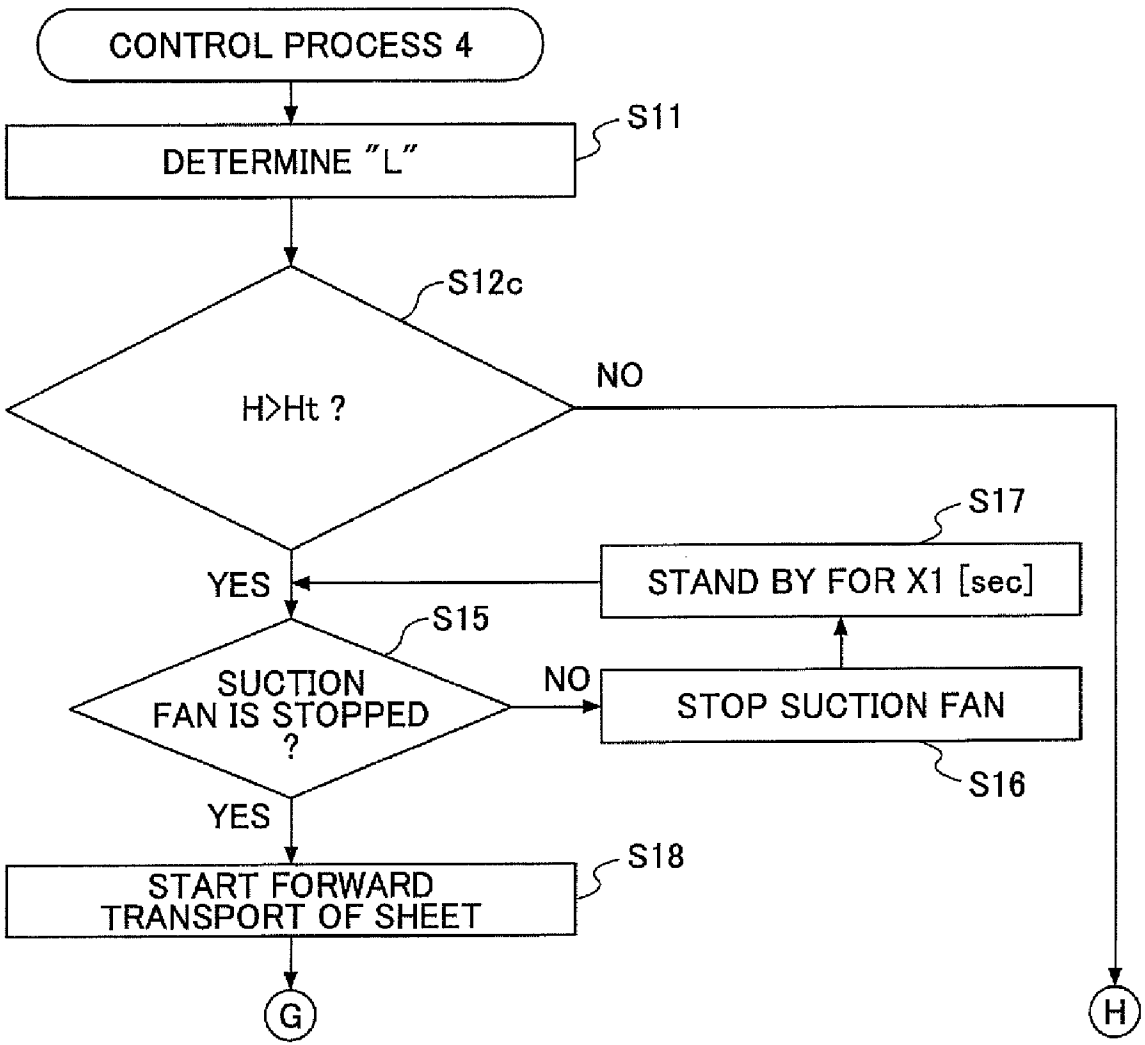
FIG. 10A is a first flowchart for explaining a control process 4 executed by the controller 200.
Figure 10B:
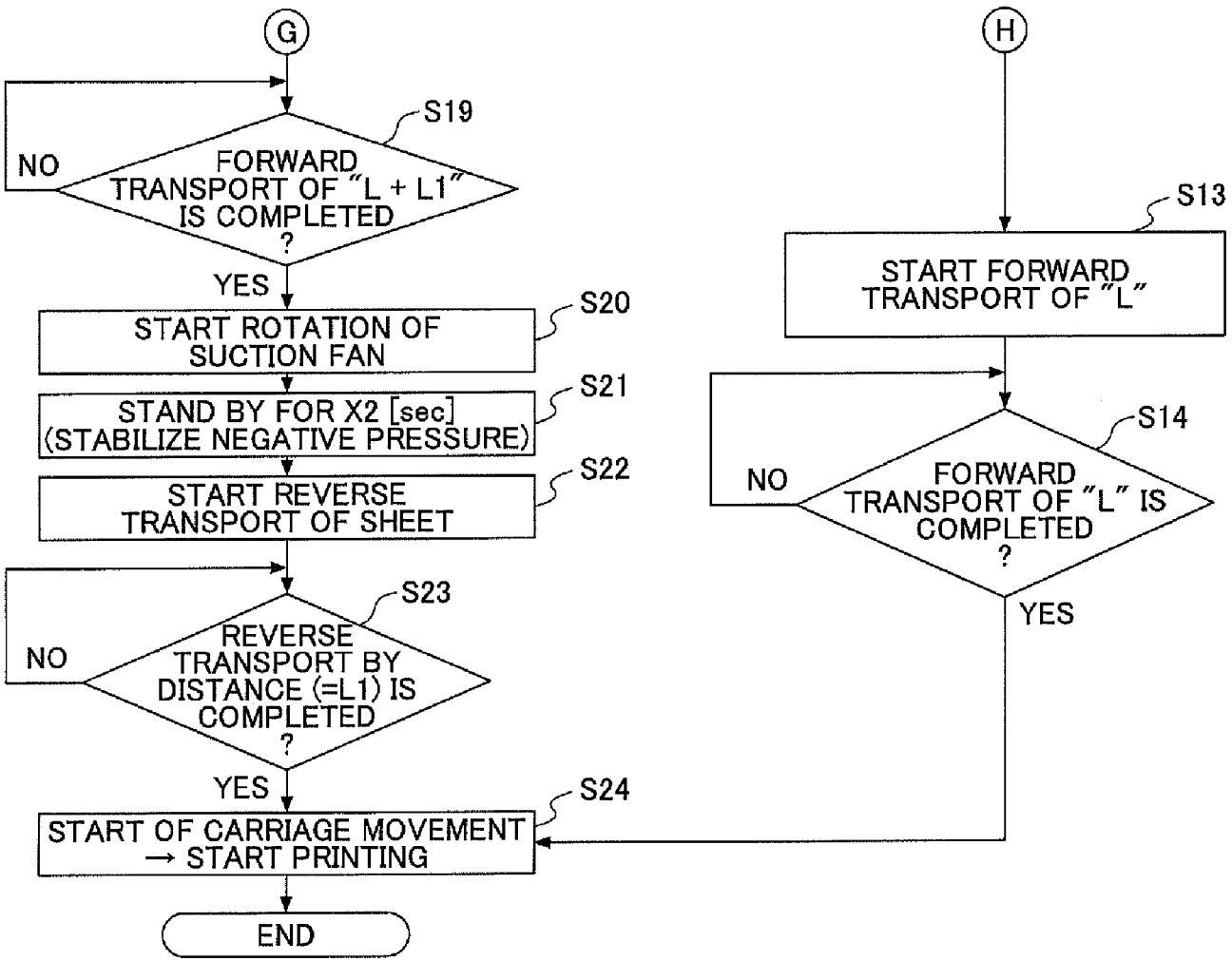
FIG. 10B is a second flowchart for explaining the control process 4 executed by the controller 200.

FIG. 10A and FIG. 10B are flowcharts for explaining a control process 4 executed by the controller 200. In FIG. 10A and FIG. 10B, the same process as the process of FIG. 7A and FIG. 7B is denoted by the same reference numerals and its explanation is omitted.

In S12*c* (process corresponding to claim 5) of FIG. 10A, as a condition of a transport method where the transport direction of the sheet P is changed from the forward direction to the reverse direction, it is determined whether humidity H measured by the humidity sensor 220 installed in the image forming apparatus is equal to or greater than a threshold Ht ($H \geqq Ht$). The threshold Ht of the humidity is set to, for example, "humidity=70%".

The determination threshold Ht of the humidity is a threshold which is fixed at the time of shipment or can be adjusted in a later process, and is stored in the ROM 180 provided in the image forming apparatus.

In S12*c*, when the humidity H measured by the humidity sensor 220 is lower than the threshold Ht, since the humidity is low so that a curl (loop) does not easily occur in the printed sheet P, the process goes to S13. The transport roller 80 is forward rotated (rotation in the clockwise direction), and the transport of the sheet P in the Xa direction is started. In a control process after this, since S13, S14 and S24 are executed similarly to the case of FIG. 7A and FIG. 7B, its explanation is omitted.

Besides, in S12*c*, when the humidity measured by the humidity sensor 220 is greater than the threshold Ht, since the humidity is high so that a curl (loop) is likely to occur in the sheet, the forward transport and the reverse transport of S18 through S24 are performed.

As stated above, when the controller 200 executes the control process 4, and when the humidity is equal to or greater than the threshold Ht, after the sheet P is transported in the forward direction (Xa direction), the suction fan 70A is rotated, and while the sheet P is forced onto the platen guide plate 30, the sheet is transported in the reverse direction (Xb direction) to remove the curl (loop) of the sheet P. Printing by the recording head 20 is started when the plane precision of the sheet P is ensured. Thus, the sheet P is prevented from contacting the nozzle surface of the recording head 20, so that the nozzle surface of the head and the sheet are not soiled. Besides, the image quality is improved and the printing precision is further raised, so that the reliability of the precise printing can be raised.

In the control process 4 of FIG. 10A and FIG. 10B, although the example is described in which the forward transport and the reverse transport of the sheet P performed at S18 to S23 are executed only one time, they may be performed plural times.

Figure 11A:
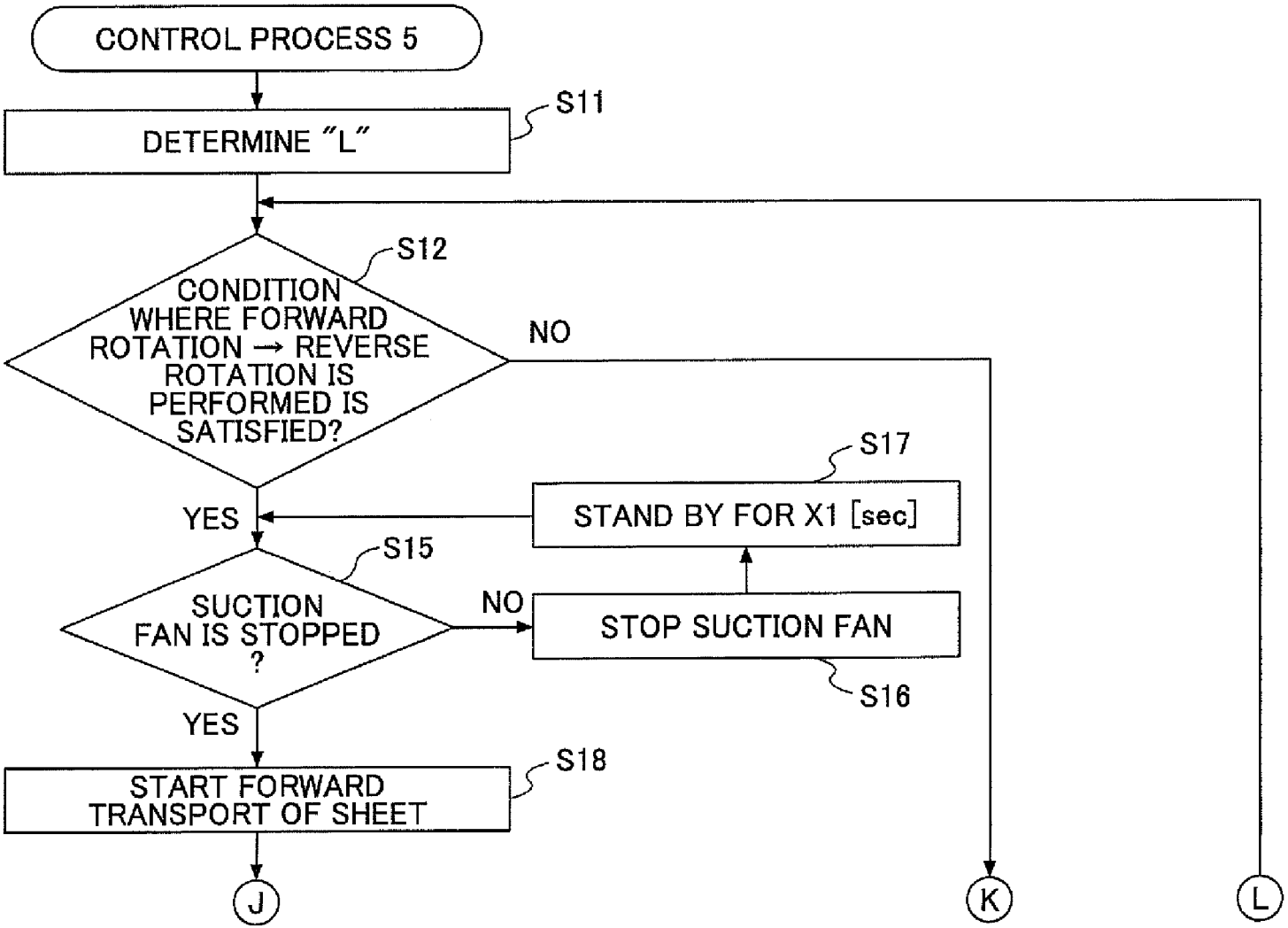
FIG. 11A is a first flowchart for explaining a control process 5 executed by the controller 200.
Figure 11B:
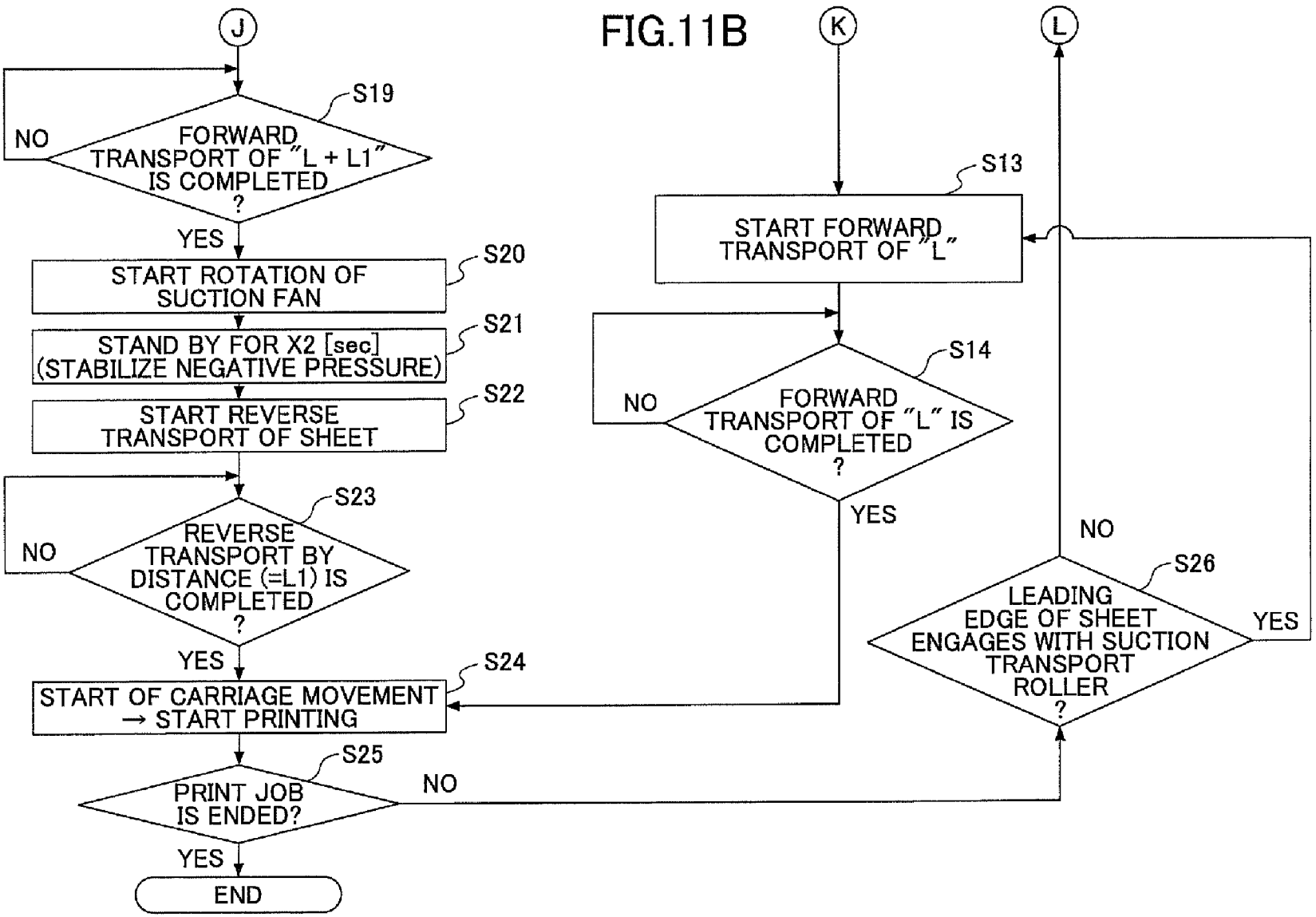
FIG. 11B is a second flowchart for explaining the control process 5 executed by the controller 200.

FIG. 11A and FIG. 11B are flowcharts for explaining a control process 5 executed by the controller 200. In FIG. 11A and FIG. 11B, the same process as the process of FIG. 7A and FIG. 7B is denoted by the same reference numerals and its explanation is omitted.

At S25 of FIG. 11A, it is determined whether an inputted print job has ended. In S25, when the print job has not ended, the process goes to S26, and it is determined whether the leading edge of the sheet P engages with the suction transport roller 36. In S26, for example, when the leading edge of the sheet P is detected by the sheet detection sensor 230 disposed in the vicinity of the platen guide plate 30, it is determined that the leading edge of the sheet P engages with the suction transport roller 36 (process corresponding to claim 6).

In S26, when the leading edge of the sheet P engages with the suction transport roller 36, since a curl (loop) of the sheet P passing through the print area A does not easily occur, the forward transport and the reverse transport are not performed after this. The process goes to S13 and a control process of only the forward transport of S13 and S14 is executed. However, in S26, when the leading edge of the sheet P is not detected by the sheet detection sensor 230, it is determined that the leading edge of the sheet P does not engage with the suction transport roller 36. In this case, since there is a high probability that a curl (loop) will occur in the leading edge of the sheet P, the process returns to S12, and the control process is executed to perform the forward transport and the reverse transport in S12 and the following.

Besides, in S25, when the print job is ended, the control process at this time is ended.

As stated above, until the leading edge of the sheet P reaches the suction transport roller 36, the forward transport and the reverse transport at S12 and the following are repeated. As a result of this, the printing efficiency (productivity) can be improved by performing the forward transport and the reverse transport. Further, the sheet P is prevented from contacting the nozzle surface of the recording head 20, so that the nozzle surface of the head and the sheet are not soiled. Besides, the image quality is improved and the printing precision is further raised, so that the reliability of the precise printing can be raised.

Figure 12A:
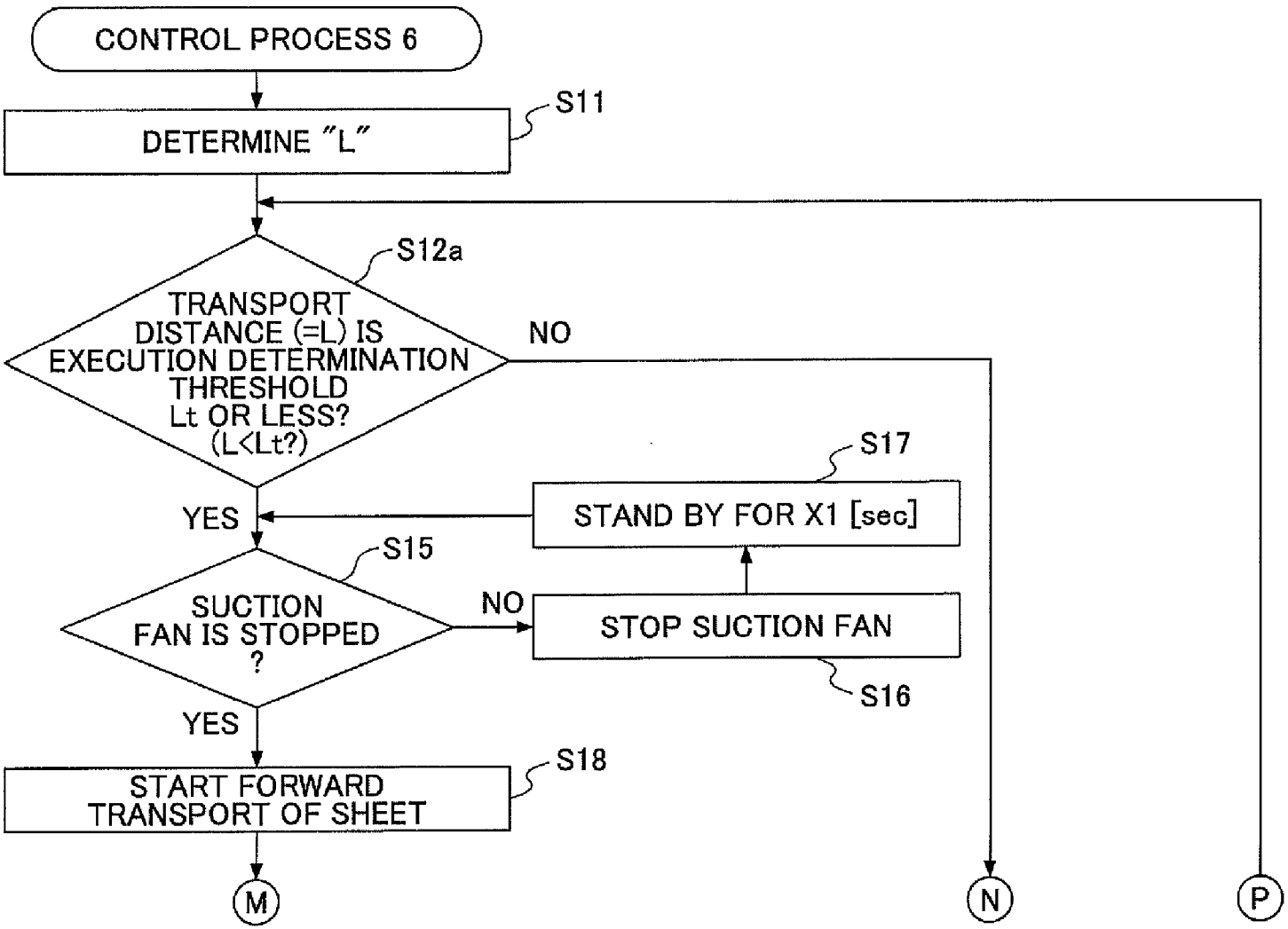
FIG. 12A is a first flowchart for explaining a control process 6 executed by the controller 200.
Figure 12B:
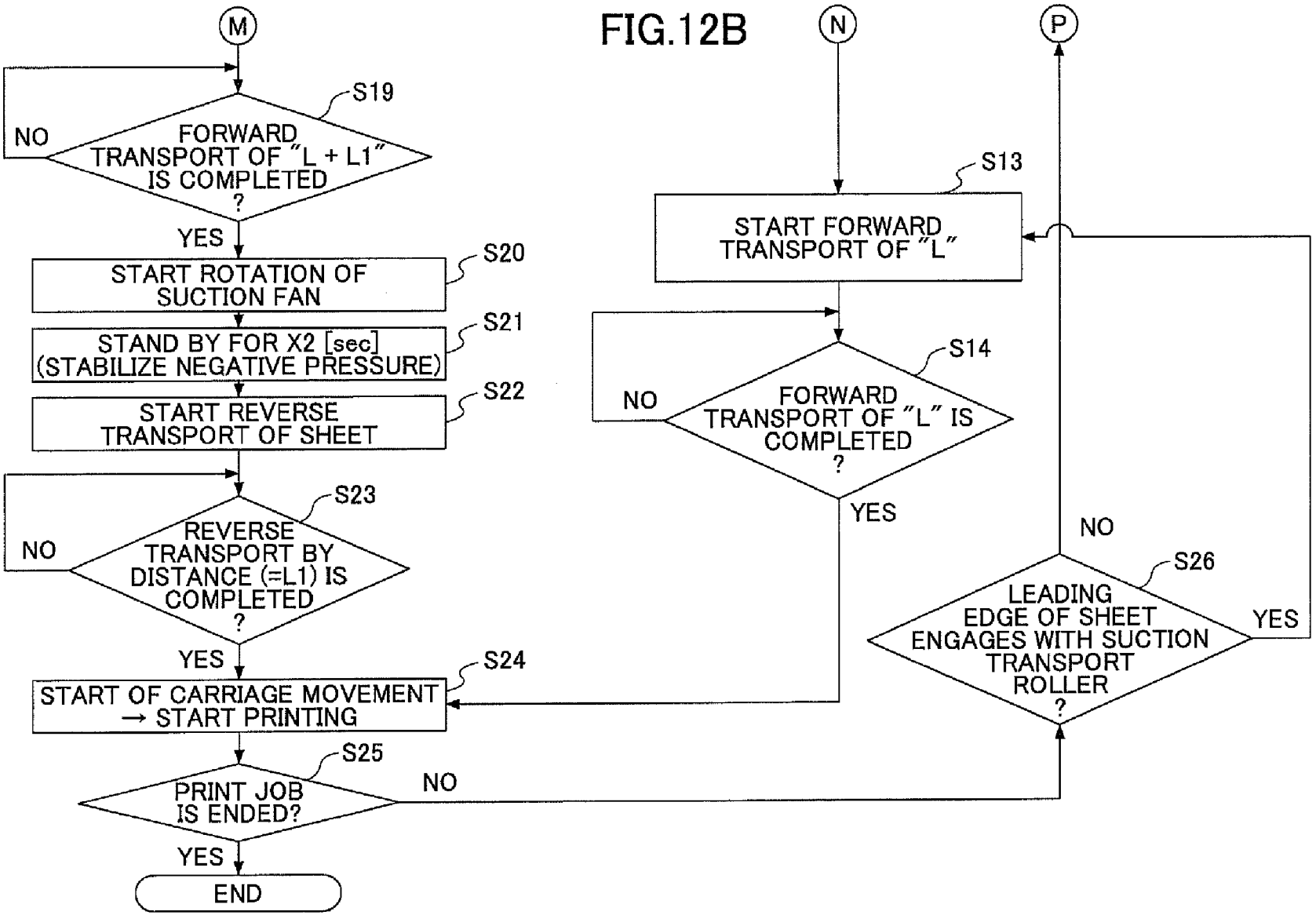
FIG. 12B is a second flowchart for explaining the control process 6 executed by the controller 200.
Figure 13A:
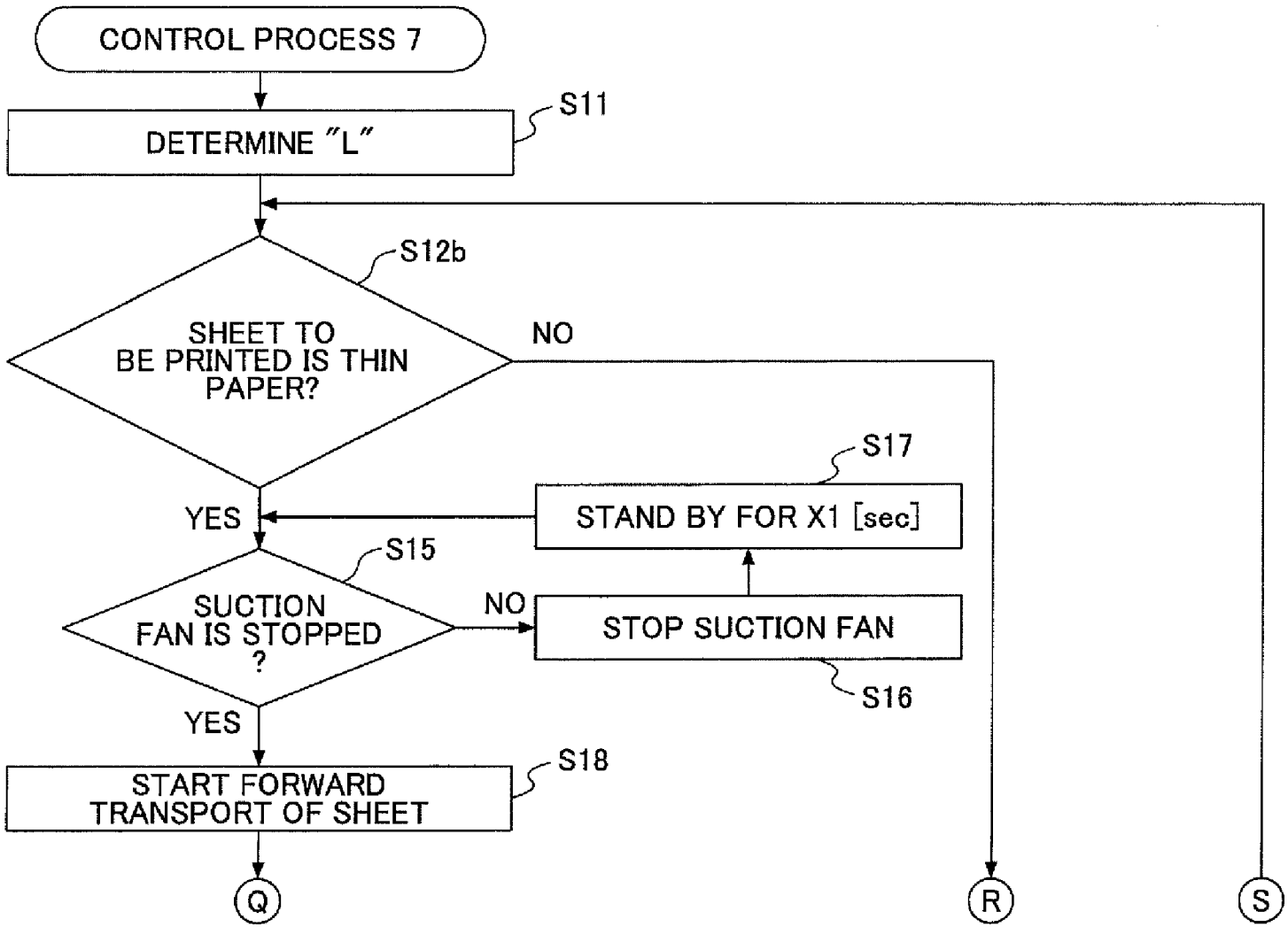
FIG. 13A is a first flowchart for explaining a control process 7 executed by the controller 200.
Figure 13B:
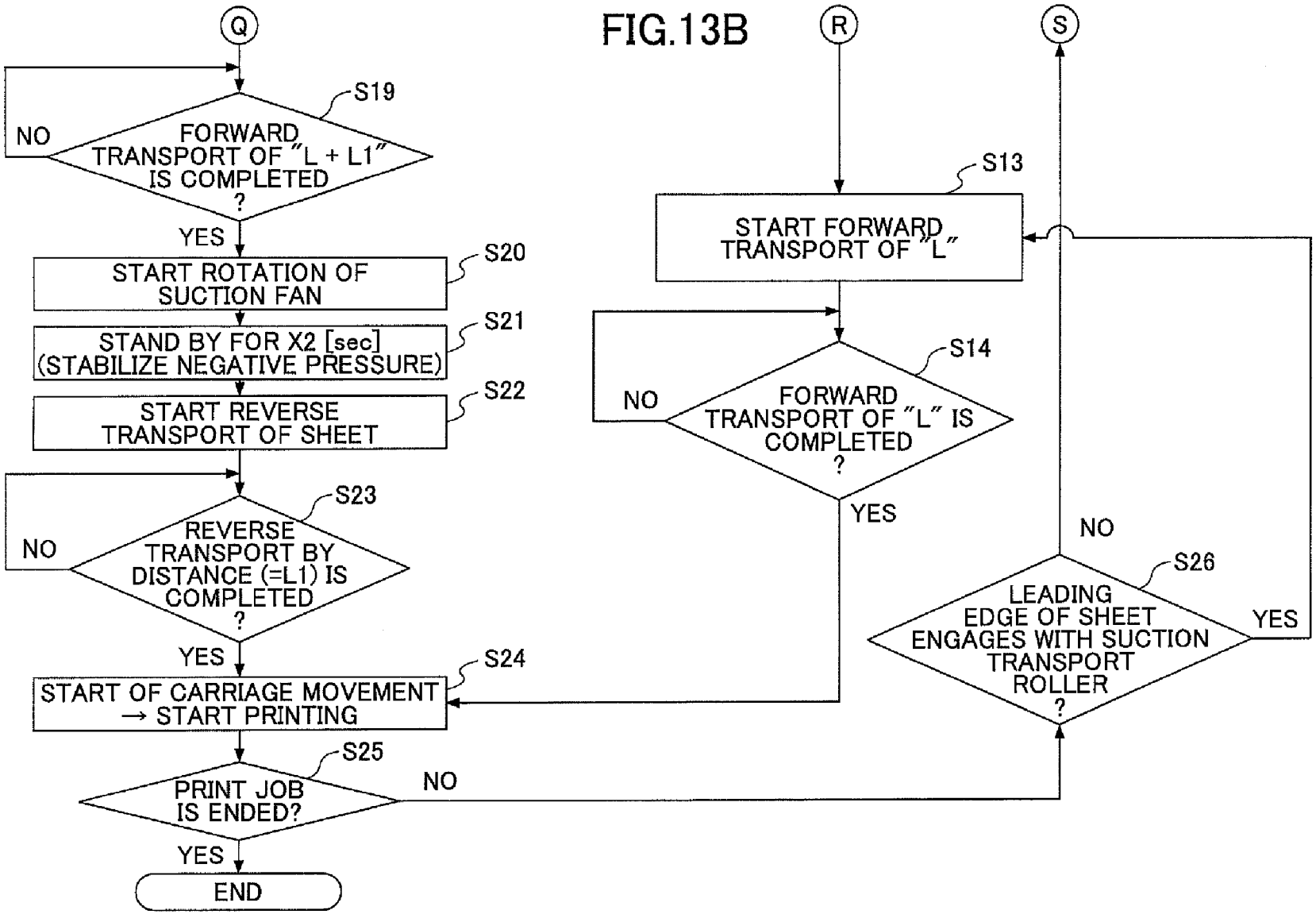
FIG. 13B is a second flowchart for explaining the control process 7 executed by the controller 200.
Figure 14A:
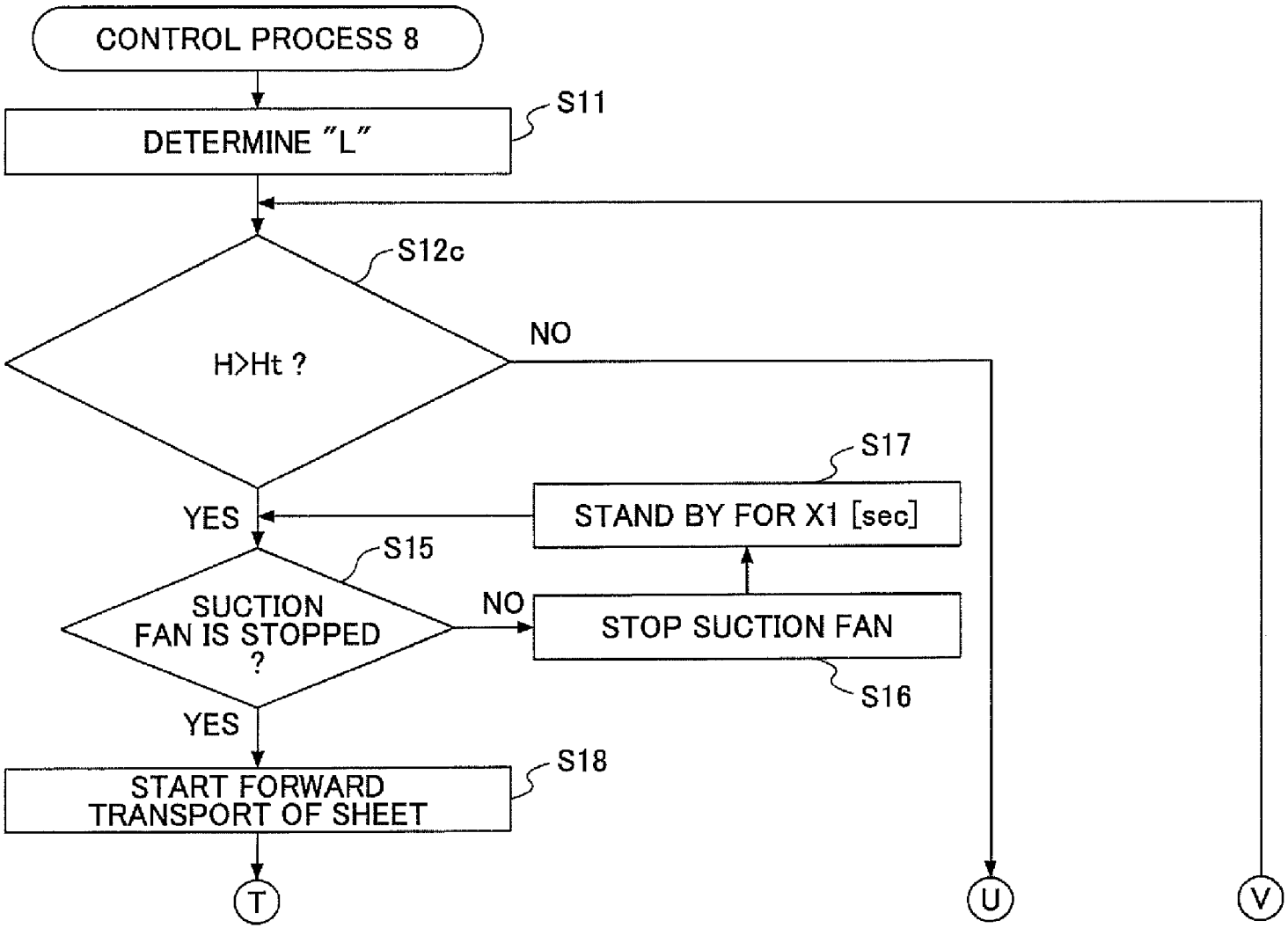
FIG. 14A is a first flowchart for explaining a control process 8 executed by the controller 200.
Figure 14B:
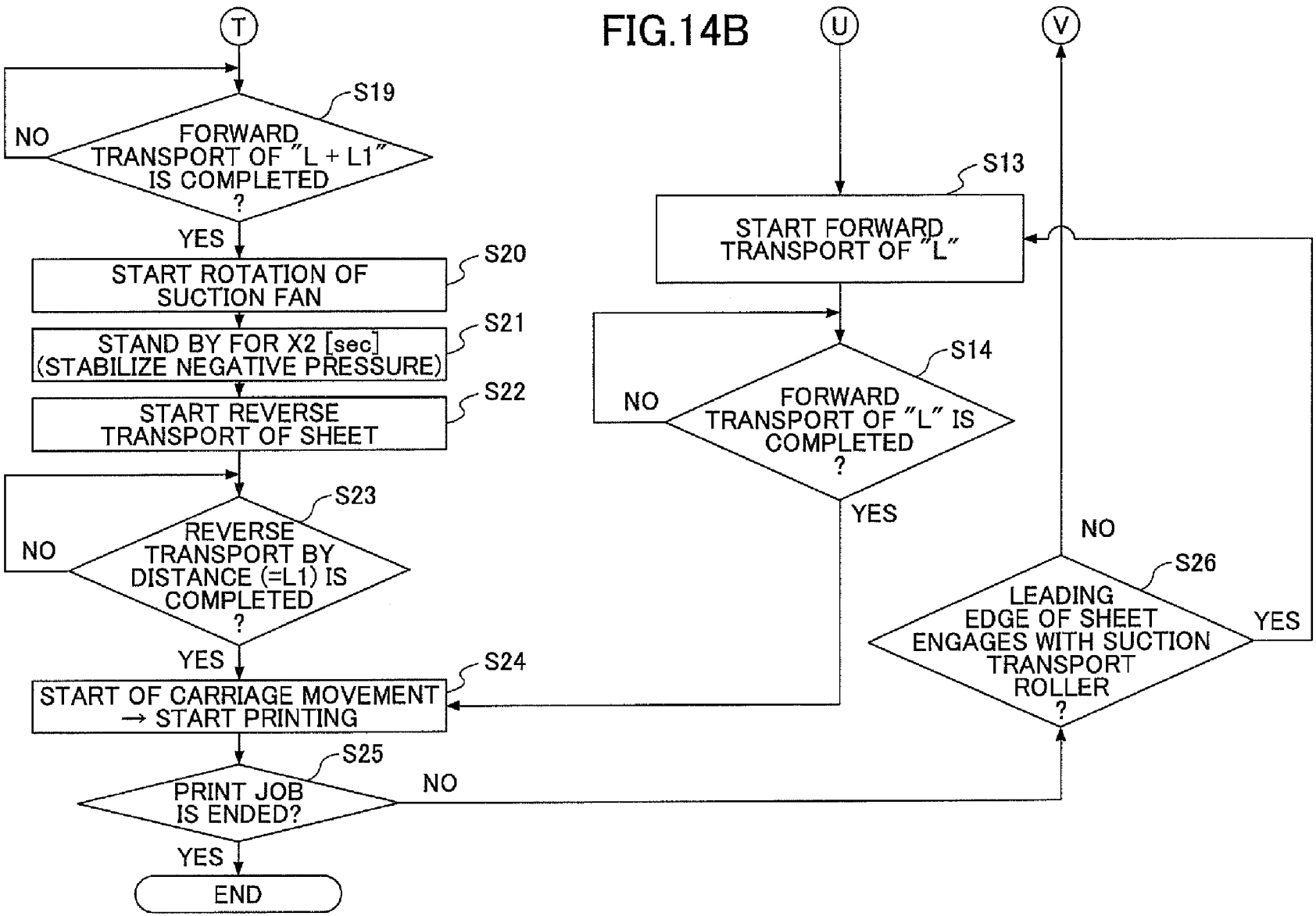
FIG. 14B is a second flowchart for explaining the control process 8 executed by the controller 200.

Besides, instead of S12 of the control process 5 shown in FIG. 11A and FIG. 11B, as a condition of a transport method where the transport direction of the sheet P is changed from the forward direction to the reverse direction, S12*a* of a control process 6 shown in FIG. 12A and FIG. 12B (whether the intermittent transport distance L of the sheet P is an execution determination threshold Lt or less), S12*b* of a control process 7 shown in FIG. 13A (whether the thickness of the sheet P is a threshold or less), or S12*c* of a control process 8 shown in FIG. 14A (whether humidity is a threshold Ht or higher) can be performed. Incidentally, since S12*a* of FIG. 12A (process corresponding to claim 8), S12*b* of FIG. 13A (process corresponding to claim 9), and S12*c* of FIG. 14A (process corresponding to claim 10) are the same as the control processes of S12*a* of FIG. 8A, S12*b* of FIG. 9A, and S12*c* of FIG. 10A, their explanation is omitted.

In the above embodiments, although the inkjet-type image forming apparatus used for the printer is described, the image forming apparatus of the invention can be naturally applied to a facsimile apparatus, a copying apparatus, a printer/fax/copier multi-function peripheral or the like in addition to the printer.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that the various changes, substitutions, and alterations could be made hereto without departing from the spirit and scope of the invention.

What is claimed is:

1. An inkjet-type image forming apparatus, comprising:

a recording head configured to eject ink to form an image;

a carriage where the recording head is provided, the carriage being configured to reciprocate in a direction orthogonal to a sheet transport direction;

a transport unit disposed upstream of a print area in the sheet transport direction, the transport unit being configured to intermittently transport a sheet to the print area;

a transport control unit configured to control the transport unit;

a platen guide plate to support the sheet in the print area;

a suction unit configured to suction the sheet onto the platen guide plate; and a control unit configured to stop the suction unit before the sheet is transported to the print area, then forward transport the sheet by the transport unit by a specified distance obtained by adding an extended distance to a target intermittent transport distance, then actuate the suction unit to cause the sheet to be forced onto the platen guide plate, and then reverse transport the sheet by the transport unit while the sheet is suctioned to cause a leading edge of the sheet to be located at the downstream end of the intermittent transport distance.

2. The inkjet-type image forming apparatus according to claim 1, wherein the control unit selectively performs control of the forward transport of the sheet and the reverse transport of the sheet by the transport unit based on a specified condition.

3. The inkjet-type image forming apparatus according to claim 1, wherein the control unit performs control of the forward transport of the sheet and the reverse transport of the sheet by the transport unit at a print time when the intermittent transport distance is equal to or less than a specified distance.

4. The inkjet-type image forming apparatus according to claim 1, wherein the control unit performs control of the forward transport of the sheet and the reverse transport of the sheet by the transport unit at a print time when the sheet is a thin paper having a thickness equal to or less than a specified thickness.

5. The inkjet-type image forming apparatus according to claim 1, wherein the control unit performs control of the forward transport of the sheet and the reverse transport of the sheet by the transport unit at a print time in a high humidity environment.

6. An inkjet-type image forming apparatus, comprising:

a recording head configured to eject ink to form an image;

a carriage where the recording head is provided, the carriage being configured to reciprocate in a direction orthogonal to a sheet transport direction;

a first transport unit disposed upstream of a print area in the sheet transport direction, the first transport unit being configured to intermittently transport a sheet to the print area;

a second transport unit disposed downstream of the print area, the second transport unit configured to exert a transporting force on the sheet when printed;

a transport control unit configured to control the first and the second transport units;

a platen guide plate to support the sheet in the print area;

a suction unit configured to suction the sheet onto the platen guide plate; and a control unit configured to stop the suction unit before the sheet is transported to the print area until the sheet is transported to the second transport unit and the transporting force is obtained, then forward transport the sheet by the first transport unit by a specified distance obtained by adding an extended distance to a target intermittent transport distance, then actuate the suction unit to cause the sheet to be forced onto the platen guide plate, and then reverse transport the sheet by the first transport unit while the sheet is suctioned to cause a leading edge of the sheet to be located at the downstream end of the intermittent transport distance.

7. The inkjet-type image forming apparatus according to claim 6, wherein the control unit selectively performs control of the forward transport of the sheet and the reverse transport of the sheet by the first transport unit based on a specified condition.

8. The inkjet-type image forming apparatus according to claim 6, wherein the control unit performs control of the forward transport of the sheet and the reverse transport of the sheet by the first transport unit at a print time when the intermittent transport distance is equal to or less than a specified distance.

9. The inkjet-type image forming apparatus according to claim 6, wherein the control unit performs control of the forward transport of the sheet and the reverse transport of the sheet by the first transport unit at a print time when the sheet is a thin paper having a thickness equal to or less than a specified thickness.

10. The inkjet-type image forming apparatus according to claim 6, wherein the control unit performs control of the forward transport of the sheet and the reverse transport of the sheet by the first transport unit at a print time in a high humidity environment.

11. A sheet transporting apparatus, comprising:

a platen guide plate configured to support a sheet in a print area;

a transport unit configured to intermittently transport the sheet to the platen guide plate;

a transport control unit configured to control the transport unit;

a suction unit configured to suction the sheet onto the platen guide plate; and a control unit configured to stop the suction unit before the sheet is transported to the print area, then forward transport the sheet by the transport unit by a specified distance obtained by adding an extended distance to a target intermittent transport distance, then actuate the suction unit to cause the sheet to be forced onto the platen guide plate, and then reverse transport the sheet by the transport unit while the sheet is suctioned to cause a leading edge of the sheet to be located at the downstream end of the intermittent transport distance.

* * * * *